US005937240A

United States Patent [19]

Kanno et al.

[11] Patent Number: 5,937,240

[45] Date of Patent: Aug. 10, 1999

[54] PROCESS CARTRIDGE HAVING POSITIONING MEMBERS AND IMAGE FORMING APPARATUS USING SUCH A PROCESS CARTRIDGE

[75] Inventors: Kazuhiko Kanno, Urawa; Tsutomu Nishiuwatoko, Tokyo; Kouji Miura, Sagamihara; Toshimitsu Iso, Kawasaki, all of Japan

[73] Assignee: Canon Kabushiki Kaisha, Tokyo, Japan

[21] Appl. No.: 08/989,156

[22] Filed: Dec. 11, 1997

Related U.S. Application Data

[63] Continuation of application No. 08/429,087, Apr. 26, 1995, abandoned.

[30] Foreign Application Priority Data

Apr. 28, 1994 [JP] Japan ..... 6-091184
Apr. 21, 1995 [JP] Japan ..... 7-096885

[51] Int. Cl.[6] ..... G03G 21/18

[52] U.S. Cl. ..... 399/111; 399/113

[58] Field of Search ..... 399/110, 111, 399/113

[56] References Cited

U.S. PATENT DOCUMENTS

| | | | |
|---|---|---|---|
| 4,566,780 | 1/1986 | Kajita et al. | 399/125 |
| 4,585,324 | 4/1986 | Koyama et al. | 399/111 |
| 4,702,587 | 10/1987 | Miyoshi | 399/110 |
| 4,862,212 | 8/1989 | Tanzawa et al. | 399/110 |
| 4,873,548 | 10/1989 | Kobayashi et al. | 399/111 |
| 5,019,867 | 5/1991 | Yamakawa et al. | 399/119 |
| 5,047,803 | 9/1991 | Kanoto | 399/111 |
| 5,061,959 | 10/1991 | Kinoshita et al. | 399/113 |
| 5,331,373 | 7/1994 | Nomura et al. | 399/111 |
| 5,500,714 | 3/1996 | Yashiro et al. | 399/111 |
| 5,528,342 | 6/1996 | Setoriyama | 399/107 |
| 5,585,889 | 12/1996 | Shishido et al. | 399/113 |
| 5,585,902 | 12/1996 | Nishiuwatoko et al. | 399/106 |
| 5,729,796 | 3/1998 | Miura et al. | 399/114 |

FOREIGN PATENT DOCUMENTS

| | | |
|---|---|---|
| 0331324 | 9/1989 | European Pat. Off. . |
| 0411825 | 2/1991 | European Pat. Off. . |
| 0467418 | 1/1992 | European Pat. Off. . |
| 0520802 | 12/1992 | European Pat. Off. . |
| 0560618 | 9/1993 | European Pat. Off. . |
| 0586043 | 3/1994 | European Pat. Off. . |
| 0586046 | 3/1994 | European Pat. Off. . |
| 0590939 | 4/1994 | European Pat. Off. . |
| 63-45556 | 3/1988 | Japan . |
| 2-042454 | 2/1990 | Japan . |
| 3-252667 | 11/1991 | Japan . |
| 4-121757 | 4/1992 | Japan . |
| 4-274453 | 9/1992 | Japan . |
| 4-282681 | 10/1992 | Japan . |
| 5-66621 | 3/1993 | Japan . |
| 5-107822 | 4/1993 | Japan . |
| 5-297649 | 11/1993 | Japan . |
| 6-19225 | 1/1994 | Japan . |
| 6-83251 | 3/1994 | Japan . |

*Primary Examiner*—William J. Royer
*Attorney, Agent, or Firm*—Fitzpatrick, Cella, Harper & Scinto

[57] ABSTRACT

A process cartridge detachably mountable to a main assembly of an image forming apparatus includes an electrophotographic photosensitive member; a process device actable on the photosensitive member; a first projection for positioning the process cartridge relative to the main assembly when the process cartridge is mounted to the main assembly, the first projection being outwardly projected from a first frame adjacent an axial end of the photosensitive member; a second projection for functioning as a pivot when the process cartridge is removed from the main assembly, the second projection being outwardly projected from a first frame; a third projection for positioning the process cartridge relative to the main assembly when the process cartridge is mounted to the main assembly, the third projection being outwardly projected from a second frame adjacent another axial end of the photosensitive member; a fourth projection for functioning as a pivot when the process cartridge is removed from the main assembly, the fourth projection being outwardly projected from the second frame.

95 Claims, 22 Drawing Sheets

PROCESS CARTRIDGE HAVING POSITIONING MEMBERS AND IMAGE FORMING APPARATUS USING SUCH A PROCESS CARTRIDGE

This application is a continuation of application Ser. No. 08/429,087, filed Apr. 26, 1995, now abandoned.

FIELD OF THE INVENTION AND RELATED ART

The present invention relates to a process cartridge and an image forming apparatus usable with the process cartridge.

Here, the image forming apparatus includes an electrophotographic copying machine, an electrophotographic printer (for example, LED printer, laser beam printer), an electrophotographic facsimile machine, an electrophotographic word processor, and the like.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a unit developing means and an electrophotographic photosensitive member.

An image forming apparatus using an electrophotographic process is known and is used with the process cartridge. This is advantageous in that the maintenance operation can be, in effect, carried out by the users thereof without expert service persons, and therefore, the operation can be remarkably improved. Therefore, this type is now widely used.

In the process cartridge, improvement in the operation in mounting and demounting relative to the main assembly of the image forming apparatus, is desired.

U.S. Pat. Nos. 4,873,548 and 5,047,803 propose some improvement.

In U.S. Pat. No. 4,873,548, a first frame is provided with a positioning member, and the process cartridge is mounted to the second frame, and when the frame is closed, the positioning member functions to effect the positioning.

In U.S. Pat. No. 5,047,803 proposes that in order to facilitate removal of the process cartridge from the main assembly of the image forming apparatus, an urging force is applied to the process cartridge in response to opening of the openable and closable member.

The above-described patents attempt to improve the mounting and demounting operation.

Further improvement is desirable.

SUMMARY OF THE INVENTION

Accordingly, it is a principal object of the present invention to provide a process cartridge and an image forming apparatus usable with the process cartridge wherein the process cartridge can be positioned correctly in place.

It is another object of the present invention to provide a process cartridge and an image forming apparatus usable with the process cartridge wherein the mounting and demounting of the process cartridge is easily performed.

It is a further object of the present invention to provide a developing frame capable of efficiently accommodating toner, a process cartridge using the developing frame, and an image forming apparatus usable with the process cartridge.

According to an aspect of the present invention, when the process cartridge is mounted in the main assembly, it is inserted such that a first projection and a second projection of the process cartridge is supported on a guide of the main assembly. When it is demounted from the main assembly, the process cartridge is rotated about the second projection by which the engagement of the first projection and a positioning recess can be released. Thus, the process cartridge can be demounted from the main assembly smoothly.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The first embodiment will be described as a preferable embodiment, referring to FIGS. 1 to 16, and then, other embodiments will be described referring to FIGS. 18 to 20, and FIGS. 21 to 25.

Embodiment 1

The first embodiment will be described regarding: (1) General structures of the image forming apparatus and process cartridge; (2) Frame structure of the developing means; (3) Shutter structure; and (4) Structure for installing or removing the cartridge.

{General Structure}

Figure 1:
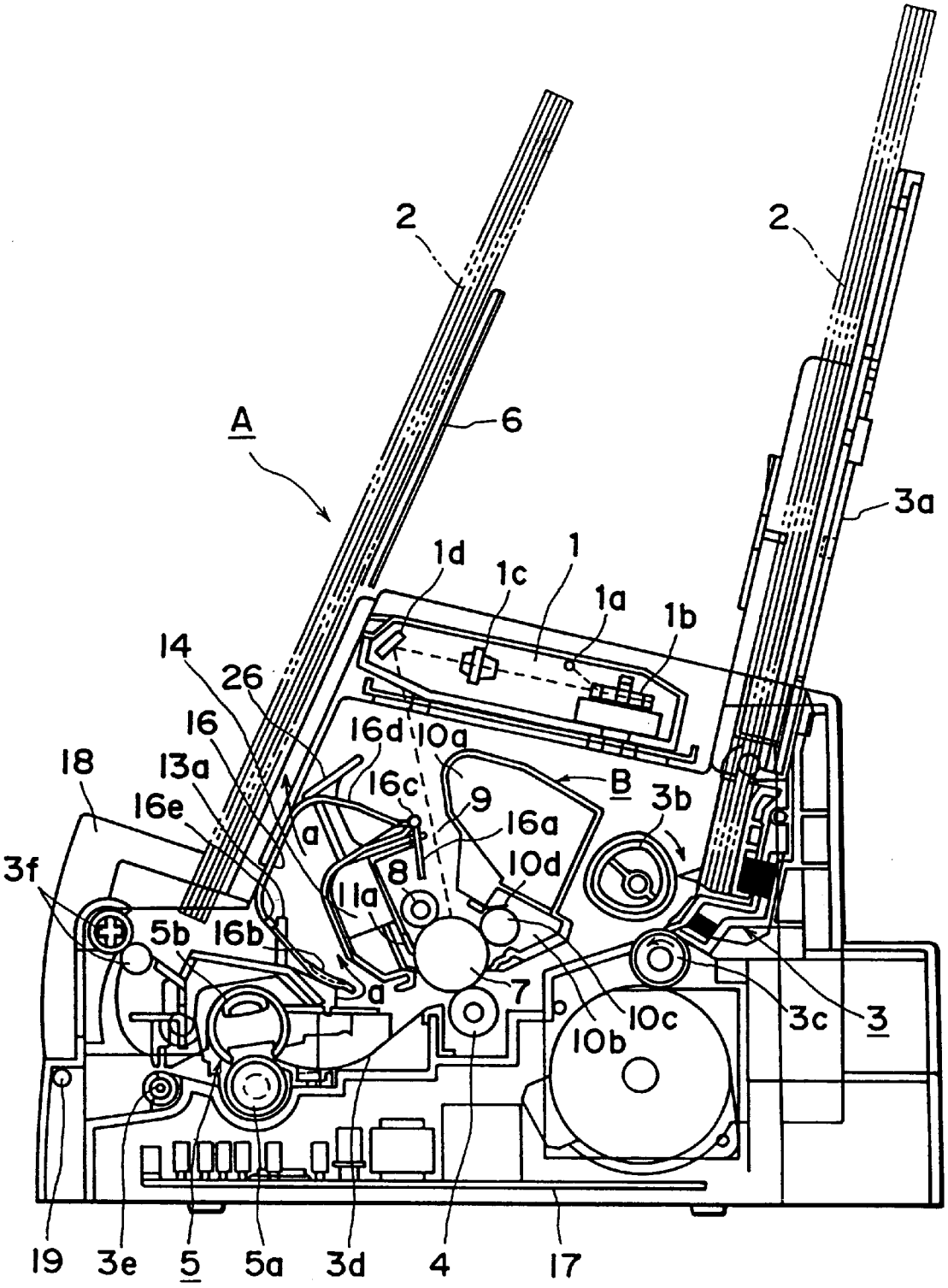
FIG. 1 is a sectional view of an image forming apparatus comprising a process cartridge.
Figure 2:
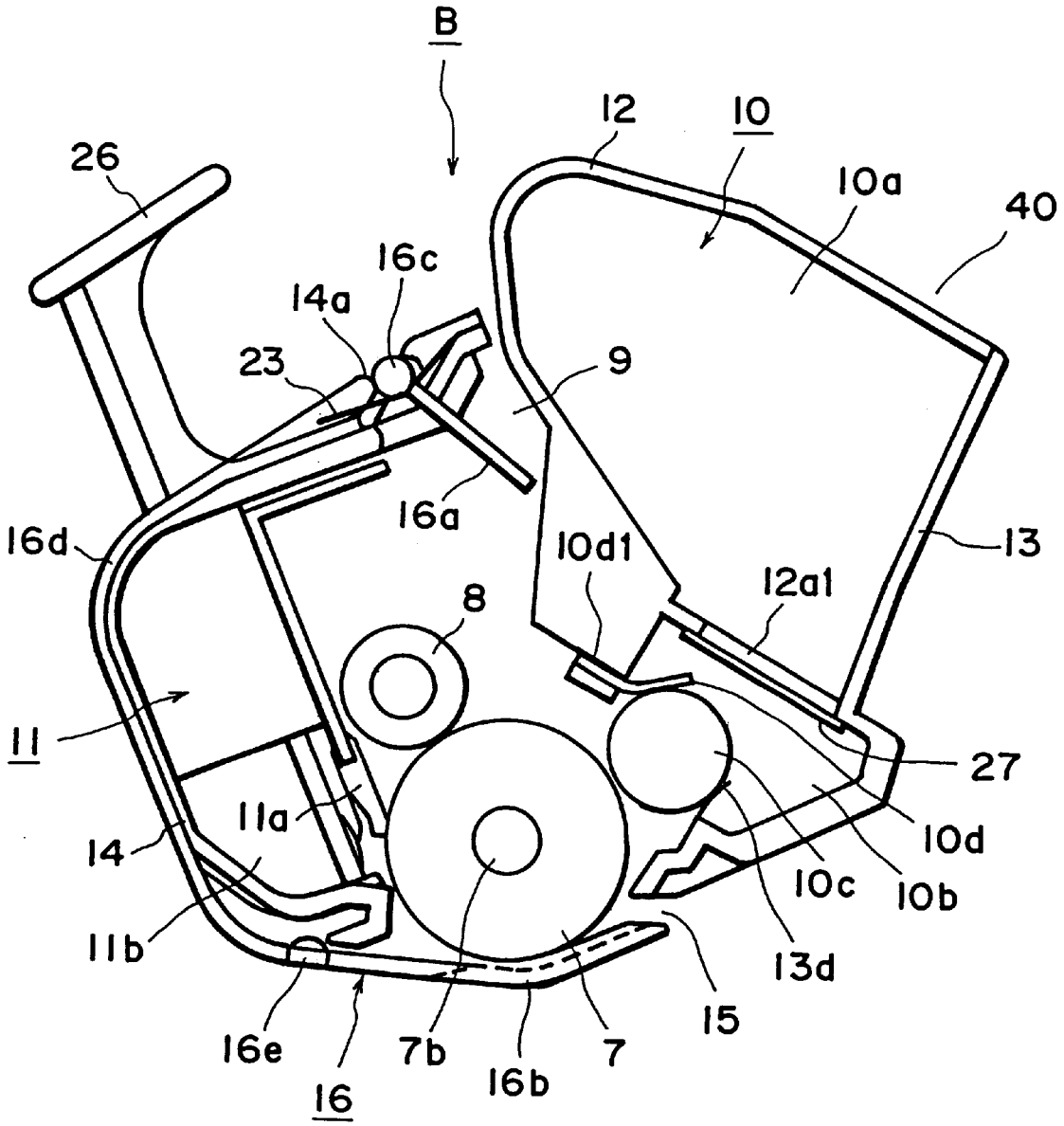
FIG. 2 is a sectional view of the process cartridge.
Figure 3:
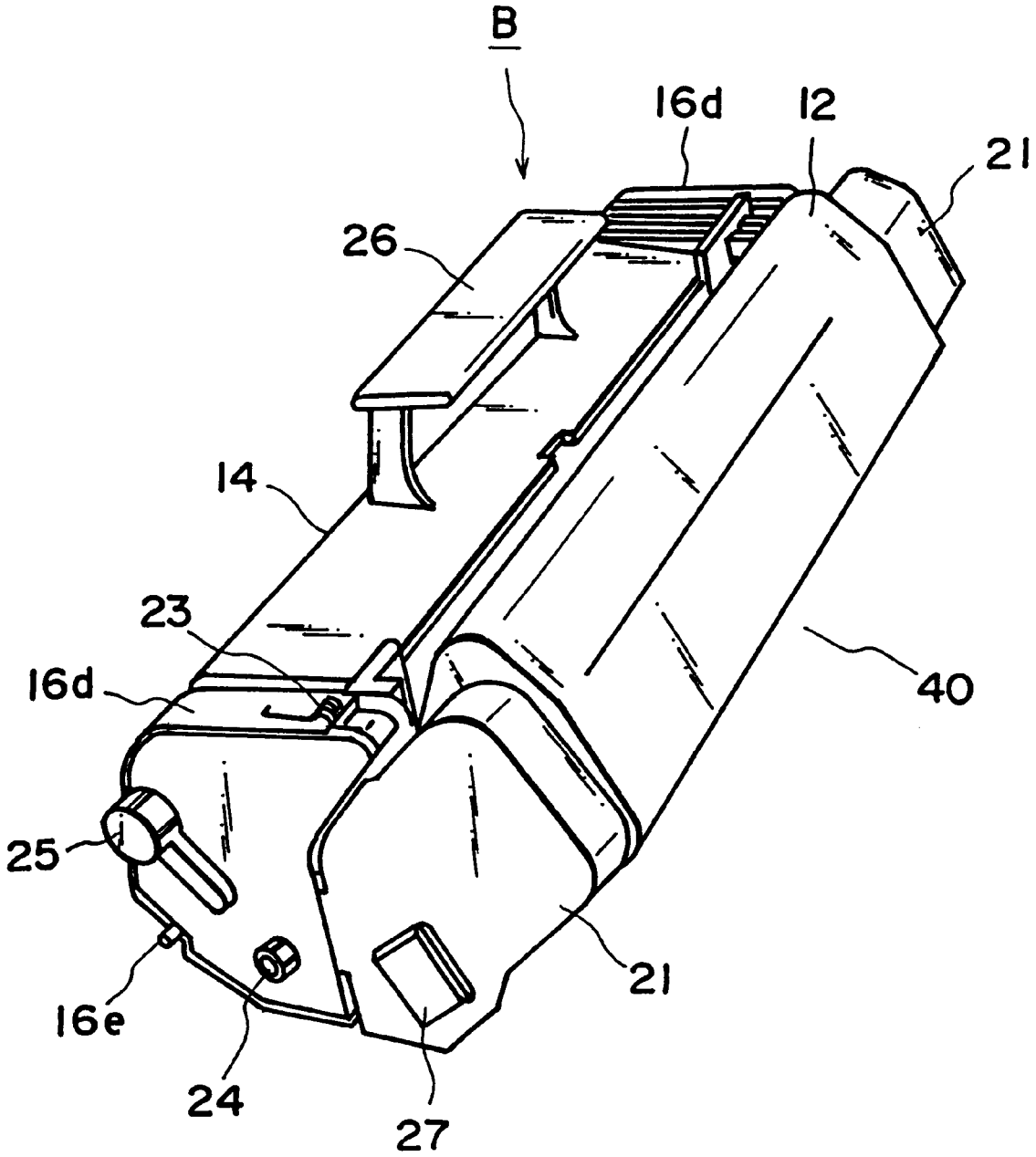
FIG. 3 is a perspective view of the process cartridge.
Figure 4:
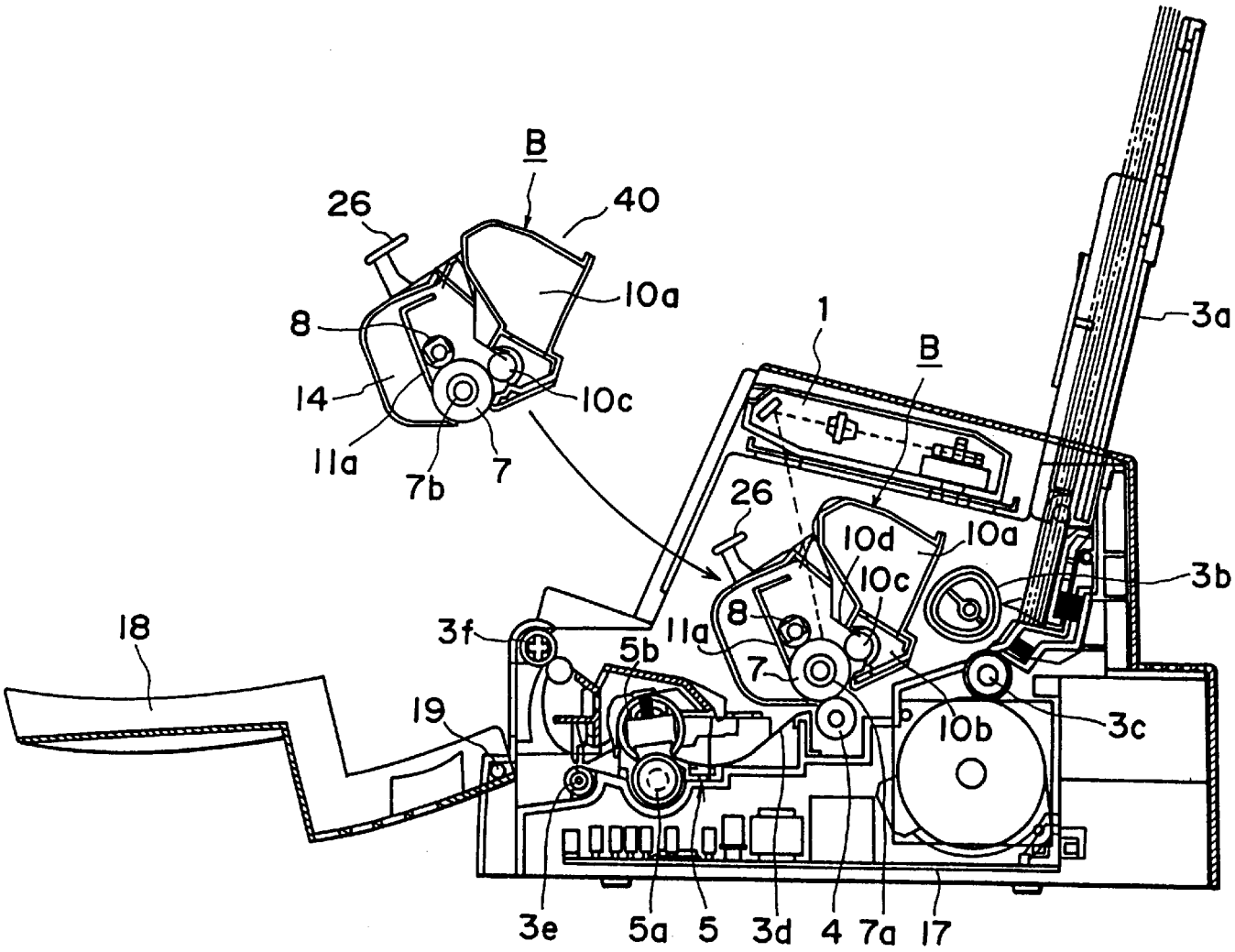
FIG. 4 is an explanatory drawing, which depicts how the cover of the image forming apparatus is opened and the process cartridge is installed in the apparatus.

The overall structures of the electro-photographic image forming apparatus and process cartridge will be described referring to FIGS. 1–4. FIG. 1 is a sectional view of the electrophotographic image forming apparatus in which the process cartridge has been installed, and depicts its overall structure. FIGS. 2 and 3 are a sectional and a perspective view of the process cartridge, respectively, and depict the corresponding structures. FIG. 4 is an explanatory drawing, which depicts how the cover of the image forming apparatus is opened and the cartridge is installed into the main assembly of the image forming apparatus.

Referring to FIG. 1, this electro-photographic image forming apparatus A is of a type which forms an image on recording medium through the electro-photographic image forming process. First, a toner image is formed on a drum-shaped electro-photographically sensitive member (hereinafter, photosensitive drum) as an image bearing member. Meanwhile, a sheet of recording medium 2 placed in a feeder tray 3*a* is conveyed by a conveying means 3 comprising a pickup roller 3*b*, conveying roller 3*c*, and the like, in synchronism with the toner image formation. Next, a voltage is applied to a transfer roller 4 as transferring means, whereby the toner image formed on the photosensitive drum, which a process cartridge B comprises, is transferred onto the recording medium 2. Then, the recording medium having received the toner image is delivered to a fixing means 5. This fixing means 5 comprises a driving roller 5*a* and a fixing roller 5*b* containing a heater, and applies heat and pressure to the recording medium 2 which is passed through the fixing means 5, whereby the transferred toner image is fixed. Next, the recording medium 2 bearing now the fixed toner image is conveyed, being flipped over while being conveyed, by discharging rollers 3*e* and 3*f* into a discharge tray 6.

In the process cartridge B, the surface of a photosensitive drum 7 as the image bearing member with a photosensitive layer is uniformly charged by applying a voltage to a charging roller 8, which is a charging means, while the photosensitive drum 7 is rotated. Next, a laser beam carrying the image data is projected by an optical system 1 onto the photosensitive drum 7 through an exposure opening 9, whereby a latent image is formed on the photosensitive drum 7. This latent image is developed with toner by a developing means 10.

The charging roller 8 is placed in contact with the photosensitive drum 7 to charge the photosensitive drum 7. The developing means 10 develops the latent image formed on the photosensitive drum 7 by supplying the toner to the photosensitive drum 7 on the regions to be developed. The optical system 1 comprises a laser diode 1*a*, a polygon mirror 1*b*, a lens 1*c*, and a full-reflection mirror 1*d*.

In this developing means 10, the toner within a toner chamber 10*a* is supplied to a developing chamber 10*b*, and as a developing roller 10*c* mounted within the developing chamber 10*b* is rotated, a layer of toner charged triboelectrically by a developing blade 10*d* is formed on the surface of the developing roller, in which a magnet is fixed. The toner is supplied from this toner layer to the photosensitive drum 7, on the region to be developed. As the toner is transferred onto the photosensitive drum 7 in correspondence with the latent image, the latent image is visualized. In other words, a toner image is formed on the photosensitive drum 7.

A voltage with a polarity opposite to that of the toner image is applied to the transfer roller 4, whereby the toner image on the photosensitive drum 7 is transferred onto the recording medium 2. Then, the residual toner on the photosensitive drum 7 is removed by a cleaning means 11. The cleaning means 11 comprises an elastic cleaning blade 11*a*, and the toner remaining on the photosensitive drum 7 is scraped off by the elastic cleaning blade 11*a* to be collected in a waste toner collector 11*b*.

Various components such as the photosensitive drum 7 are integrated into a form of cartridge, which is realized by disposing them within a cartridge frame formed by combining a developing means frame 12, a developing means wall 13, and a cleaning means frame. More specifically, the developing means frame 12 and developing means wall 13 are welded together to form the toner chamber 10*a* and developing chamber 10*b*, and the developing roller 10*b* and developing blade 10*c* are mounted within this developing chamber 10*b*. On the cleaning means frame 14, the photosensitive drum 7, charging roller 8, and various components constituting the cleaning means 11 are mounted. Finally, the process cartridge B is formed by pivotably combining the developing means frame 12 and cleaning means frame 14.

The process cartridge B is provided with an exposure opening 9, which allows the light beam carrying the image data to be irradiated onto the photosensitive drum 7, and a transfer opening 15, which allows the photosensitive drum 7 to face directly the recording medium 2 so that the toner image on the photosensitive drum 7 can be transferred onto the recording medium 2. Also, the process cartridge B comprises a shutter member 16, which exposes or covers the openings 9 and 15.

Referring to FIG. 4, the image forming apparatus A comprises a cover 18, which is mounted on the apparatus main assembly 17 in such a manner as to be rotatable about an axis 19. As the rotatable cover 18 is opened, a guiding member 20 (refer to FIG. 13) for guiding the process cartridge B into the apparatus main assembly is exposed. An operator installs the process cartridge B, or removes it, along this guiding member 20.

{Structure of Developing Means Frame}

Figure 5:
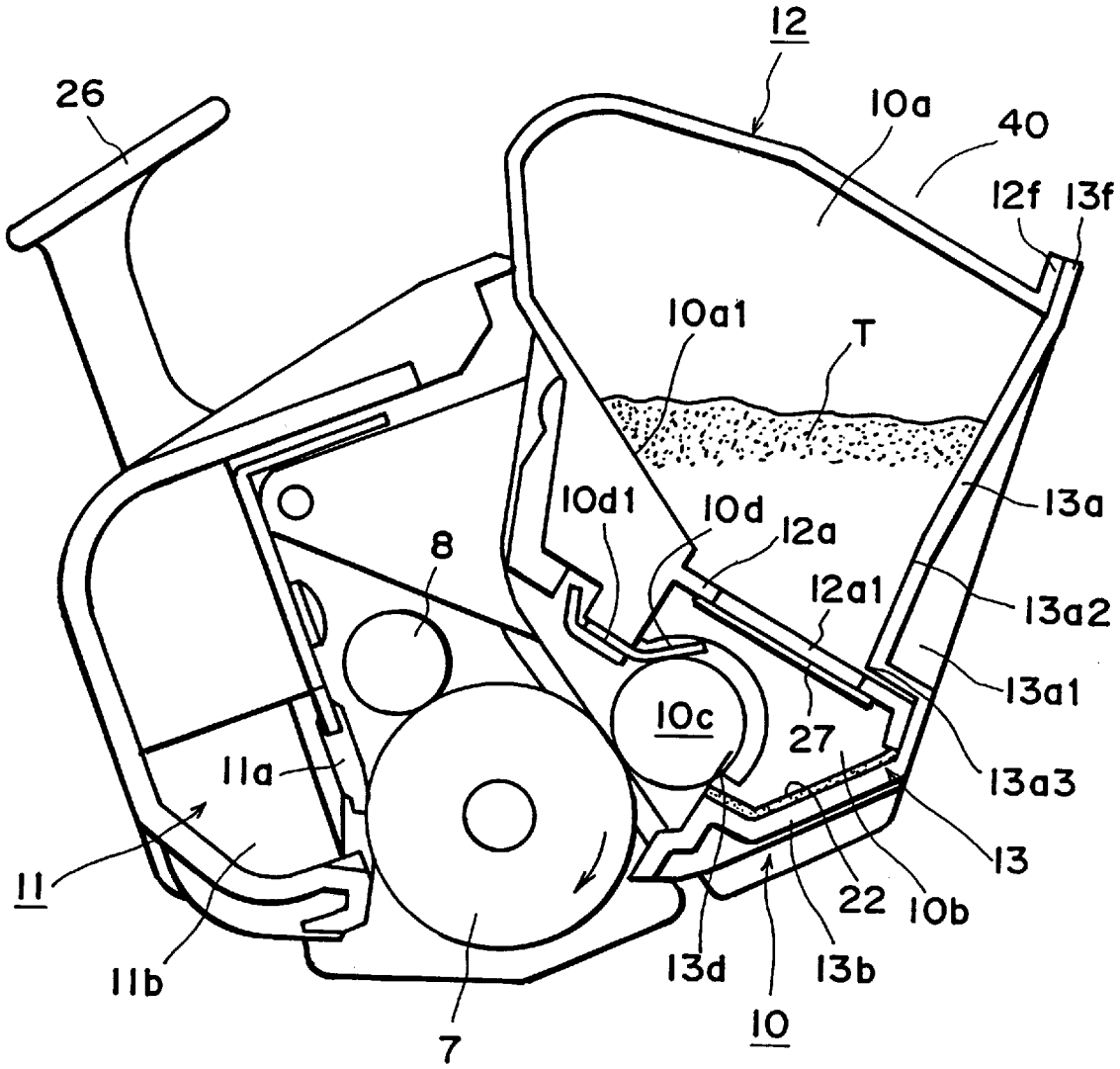
FIG. 5 is a sectional view of a developing means.
Figure 6:
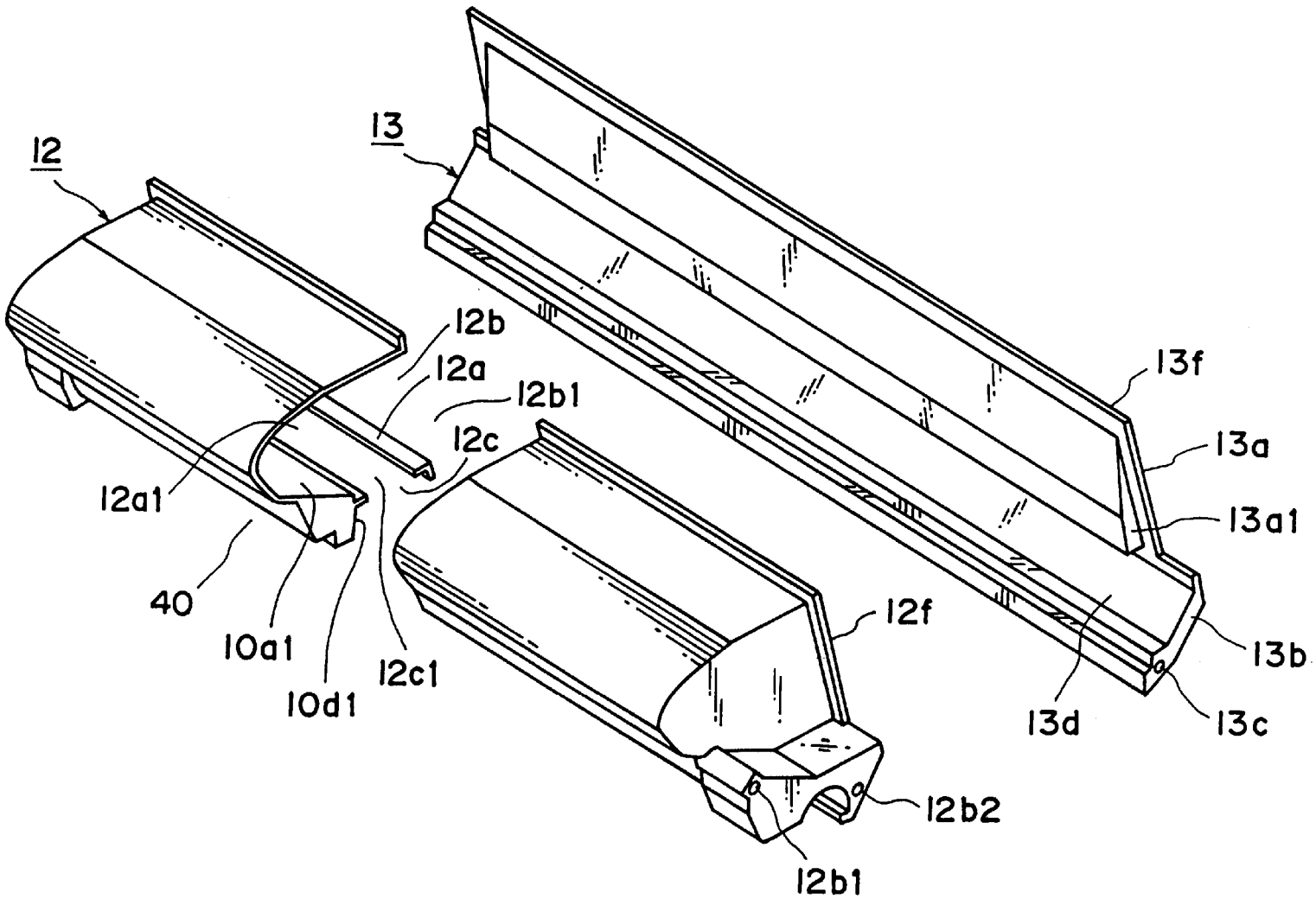
FIG. 6 is a perspective view illustrating separately the frame and wall members of the developing means.
Figure 7:
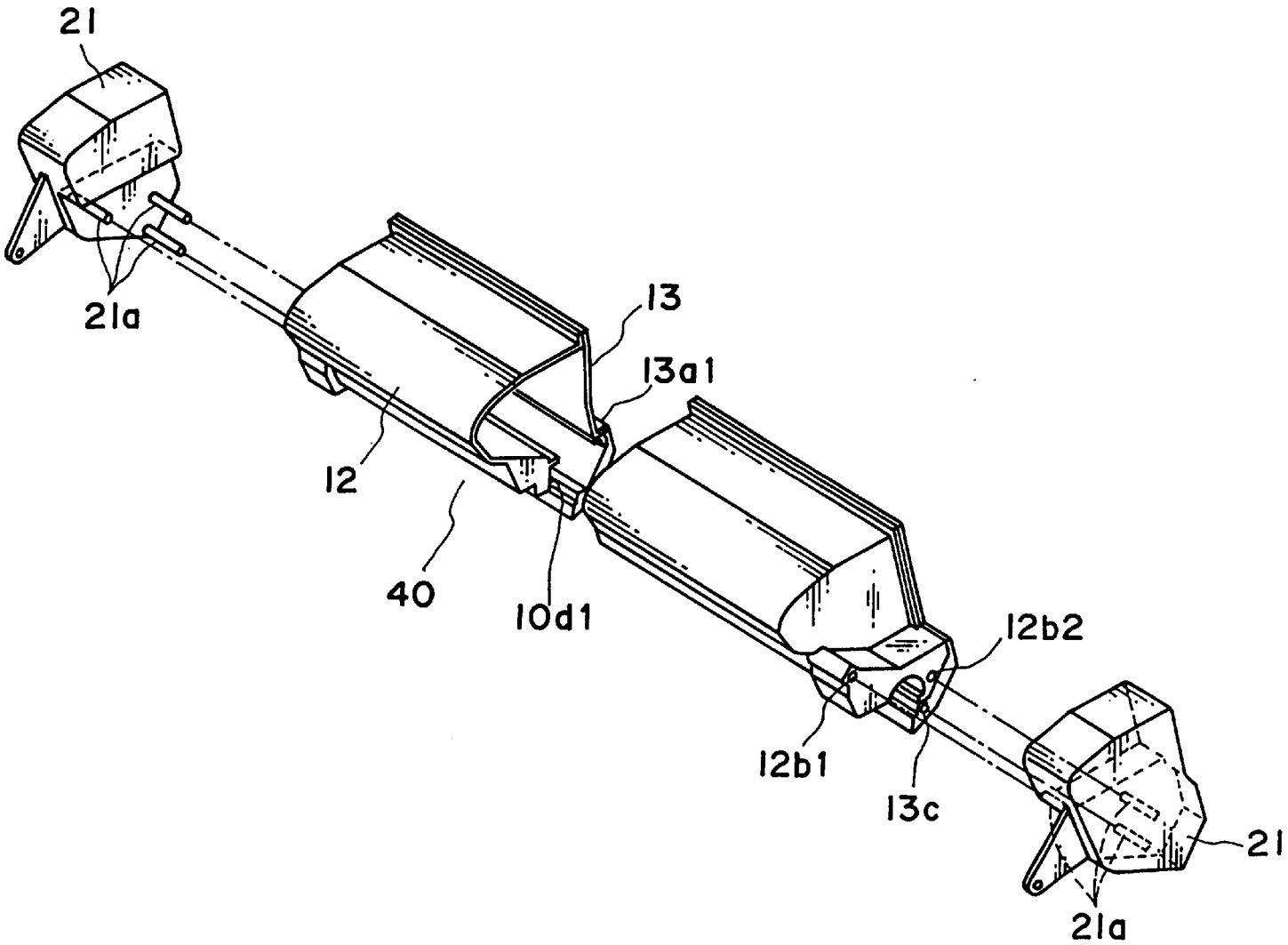
FIG. 7 is a perspective view illustrating how the developing means frame and the developing means wall are attached.

Next, referring to FIGS. 5–7, the structure of the frame constituting a portion of the developing means will be described. FIG. 5 is a sectional view of the developing means. FIG. 6 is a perspective view illustrating separately the developing means frame and developing means wall. FIG. 7 is a perspective view describing how the developing means frame and developing means wall are combined.

Referring to FIGS. 5 and 6, the developing means 10 comprises the toner chamber 10*a* and developing chamber 10*b*, which are formed by combining the developing means frame 12 and developing means wall 13.

The developing means frame 12 constitutes the main structures of the toner chamber 10*a* and developing chamber 10*b*, and comprises a toner chamber portion 12*b*, which is the portion above a seal mounting portion 12*a* provided with a toner supplying opening 12*a*1 and constitutes a portion of the toner chamber 10*a*, and the developing chamber portion 12*c*, which is the portion below the seal mounting portion 12*a* and constitutes a portion of the developing chamber 10*b*. The walls of the toner chamber section 12*b* and developing chamber portion 12*c* are opened 12*a*1 (12*c*1), wherein the toner chamber section 12*b* is formed so its opening side tapers out, and is provided with a toner filling opening (unillustrated) disposed on one of the longitudinal ends.

The developing means wall member 13 is combined with the developing means frame 12 in such a manner as to cover the open side of the developing means frame 12. It integrally comprises a toner chamber wall portion 13*a*, which is to cover the opening of the toner chamber portion 10*a* of the developing means frame 12, and a developing chamber wall portion 13*b*, which is to cover the opening of the developing chamber portion 10*b*. A recessed portion 13*a*1, which causes the toner chamber wall portion 13*a* to recess from the developing chamber wall portion 13*b*, is provided at the border line between the toner chamber wall portion 13*a* and developing chamber wall portion 13*b*.

The developing means frame 12 and developing means wall member 13 are formed of resin by injection molding.

The aforementioned components are assembled in the following manner. First, the wall member 13 is placed in a manner to cover the opening of the frame member 12, and the joints between them are welded. In this embodiment, when the frame member 12 and wall member 13 are joined, an end member 21 is attached at each of the longitudinal ends of the frame and wall members 12 and 13, as shown in FIG. 7, so that both members 12 and 13 are accurately fixed to each other.

In order to accomplish this placement, boss holes 12*b*1 and 12*b*2 are provided on each of the longitudinal end surfaces of the frame member 12, and also, boss holes 13*c* are provided on the each of the longitudinal end surfaces of the wall member 13. The end member 21 is provided with bosses 21*a* as positioning means which are fitted into the boss holes 12*b*1, 12*b*2, and 13*c*.

When the frame member 12 and wall member 13 are thus combined, the joint between the frame member 12 and toner chamber wall portion 13*a* is melt-welded, but the joint between the frame member 12 and developing chamber wall portion 13*b* is pressure-welded with the interposition of a toner leak preventing seal 22 (refer to FIG. 5) composed of foamed polyurethane. Since the joint where the seal 22 is interposed is not melt-welded, the joint is not as strong as the melt-welded joint. However, since the bosses 21*a* of the end member 21 are fitted into the correspondent boss holes 12*b*1, 12*b*2, and 13*c*, the positional relation between the frame and wall members 12 and 13 can be just as firm and reliable as in the case of the melt-welding, and further, even when a torsional force or the like is applied on the joint, no gap is liable to be generated at the joint; in other words, no toner is liable to leak from the joint.

Further, the end member fixes the positional relation between the frame member 12 and the developing roller 10*c* when the latter is mounted on the former, and also, functions as a positioning member when the cleaning means frame 14 is connected to the frame member 12, to which the wall member 13 has been welded.

When the frame member 12 and wall member 13 are joined as described above, the bottom end portion of the toner chamber wall portion 13*a* is disposed substantially level with the longitudinal edge of the toner supplying opening 12*a*1 (refer to FIG. 5) since the recessed portion 13*a*1 is provided on the wall member 13. The opening 12*a*1 is sealed by attaching a sealing member 23 to the toner supplying opening 12*a*1 by gluing, welding, or the like means, and the developing roller 10*c* and developing blade 10*d* are mounted in the developing chamber 10*a*. After the developing means 10 is assembled in this manner, toner T is filled into the toner chamber 10*a* through the aforementioned toner filling opening, and the toner filling opening is sealed with a cap (unillustrated), completing the production of the developing means 10.

Next, the cleaning means frame, to which the photosensitive drum 7, cleaning means 11, and the like have been mounted, is connected to the integrated frame and wall members 12 and 13, finishing assembling the process cartridge B.

Referring to FIG. 5, the frame member 12 is formed so the toner chamber 10*a* is above the developing chamber 10*b*, and for a portion of the toner chamber 10*a* to project toward the photosensitive drum 7 slightly beyond the developing chamber 10*b*.

In this embodiment, the first frame (frame member 12) comprises: a toner storing portion (toner chamber portion 12*b*) for storing the toner to be used for development; an opening portion 12*b*1 of the toner storing section; and a toner supplying opening 12*a*1, which allows the toner stored in the toner storing portion to be supplied to the developing station. The second frame member (wall member 13) comprises: a developing means mounting portion 13*d* where the developing roller 10*c* as the developing means is mounted; and a cover portion (toner chamber wall portion 13*a*), which closes up the opening portion 12*b*1 of the toner storing section. The first and second frames are joined to form a developing means frame. In other words, the developing means frame of this embodiment comprises: the first frame (frame member 12), which includes a toner storing portion, and a developing portion (a portion where the developing means mounting portion 13*d* is provided) for developing the latent image formed on the photosensitive drum 7, with the toner stored in the toner storing section, and extends from the toner storing section to the developing section (region directly facing the developing station; and the second frame (wall member 13), which extends from the developing section to the toner storing section (region correspondent to the toner storing section).

The first frame is provided with a developing blade mounting portion where a developing blade 10*d*1 for regulating the amount of the toner, which adheres to the circumference of the developing roller 10*c* mounted on the developing means mounting section 13*d* of the second frame, is mounted. The wall portion 10*a*1 of the toner storing portion of the first frame is slanted toward the toner supplying opening 12*a*1 so that the toner within the toner storing section is supplied to the developing region without waste. The sealing member 27 for sealing the toner supplying opening 12*a*1 is removably attached to the toner supplying opening 12*a*1. Therefore, the toner within the toner storing section is prevented from leaking out before the process cartridge B is put to use. This sealing member 27 is to be removed by the operator before the process cartridge is used.

The cover portion of the second frame member (toner chamber wall portion 13*a*) is provided with a slanted surface 13*a*2, which is slanted toward the toner supplying opening 12*a*1 when the first and second frames are joined. The location of the bottom end portion 13*a*3 of the this slanted surface 13*a*2 substantially coincides with the location of the edge portion of the toner supplying opening 12*a*1. Therefore, the toner within the toner storing section can be supplied to the developing region without being wasted.

When the first and second frames are joined, they are joined on the side where the toner storing portion is formed, that is, by the sides 12*f* and 13*f*, respectively. They may be joined by melt-welding (for example, ultrasonic welding), gluing, small screws and nuts, spring clips, or the like. Further, an end member 21 is provided for joining the first and second frames, and it is fitted at each of the longitudinal ends of the first and second frames. The end member 21 is provided with boss holes, into which bosses 21*a* provided as the positioning means on the first and second frame, on each of the longitudinal end surfaces, are fitted to fix the positional relation between the first and second frames. Further, when the first and second frames are joined, an elastic sealing member (toner leak preventing seal 22) is interposed on the side where the developing means mounting portion 13*d* is provided.

Both of the first and second frames are integrally formed of plastic material (for example, highly impact resistant styrene).

Therefore, the internal volume of the toner chamber 10*a* can be increased to store more toner without increasing the size of the process cartridge B. In addition, since the toner chamber portion 10*a* of the frame member 12 is formed so as for its open side to taper out, it can be formed of resin material or the like by injection molding.

As the sealing member 27 is peeled off when the process cartridge B begins to be used, the toner within the toner chamber 10*a* is supplied from the toner chamber 10*a* to the developing chamber 10*b* due to its own weight; therefore, it is unnecessary to provide a dedicated toner sending member. Further, when the process cartridge B is in the image forming apparatus A (in the state illustrated in FIG. 5), the seal mounting portion 12*a* slopes down towards the right, and the toner chamber wall portion 13*a* is placed substantially level with the right-hand edge portion of the toner supplying opening 12*a*1 due to the provision of the recessed portion 13*a*1 on the wall member 13; therefore, the toner does not remain on the back side of the seal mounting portion 12*a*.

It is preferable that the joint between the frame and wall members 12 and 13 is melt-welded as described before so that the joint is reliably sealed to prevent the toner leak or the like. However, they may be joined by means different from the melt-welding; they may be joined with small screws and nuts, hooks, with the interposition of sealing material such as foamed polyurethane or the like in the joint portion, or may be joined by gluing or the like means.

{Structure of Shutter}

Figure 8:
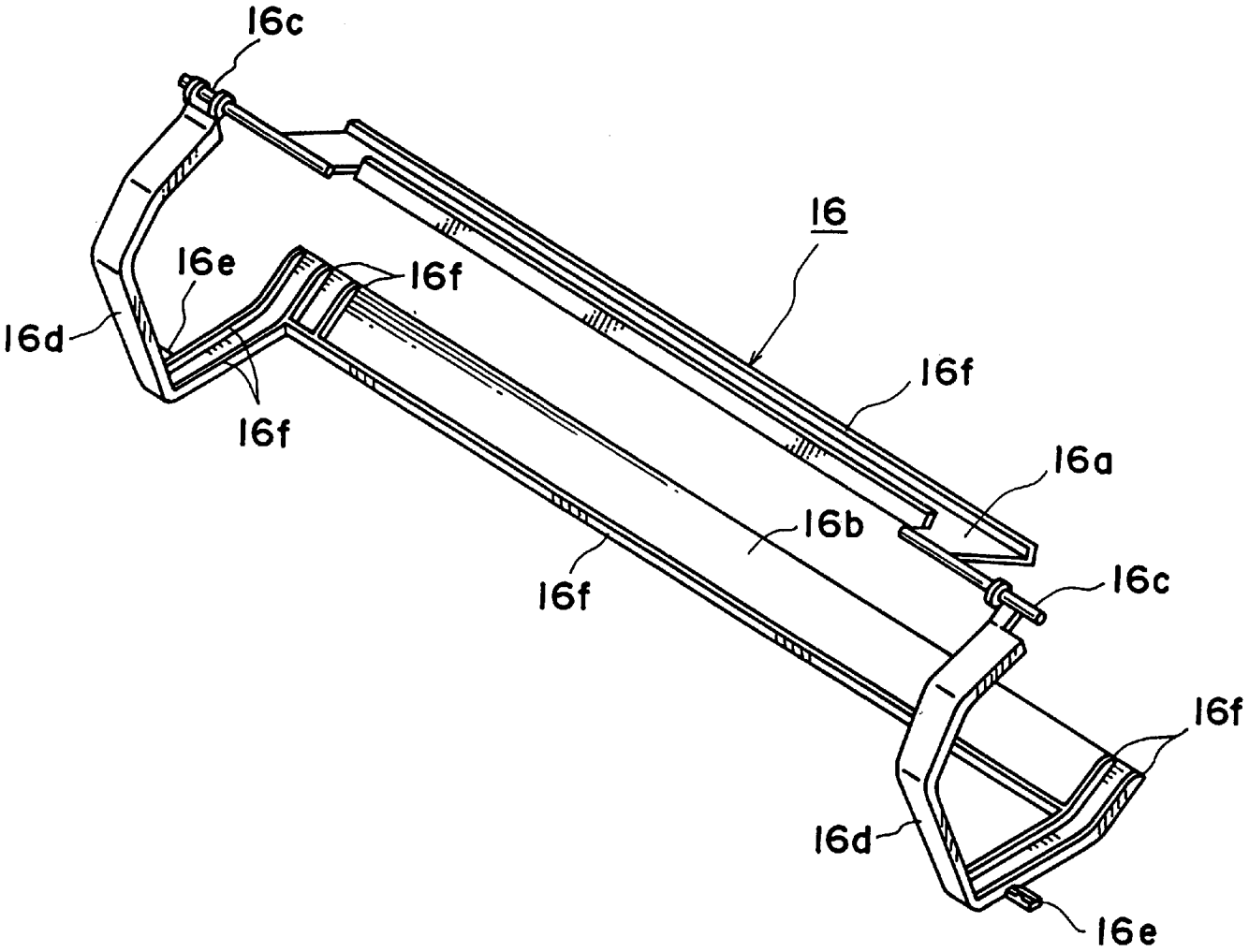
FIG. 8 is a perspective view of a shutter member.
Figure 9:
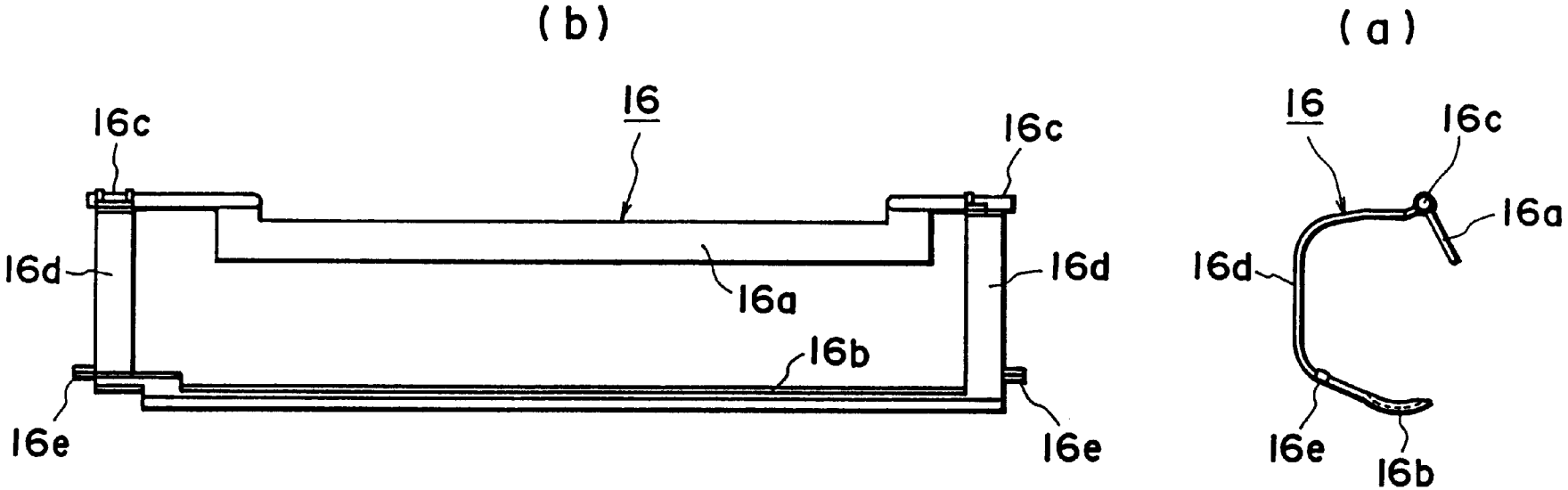
FIG. 9(*a*) is a plan view of the shutter member, and FIG. 9(*b*) is a side view of the shutter member, as seen from the longitudinal direction.
Figure 10:
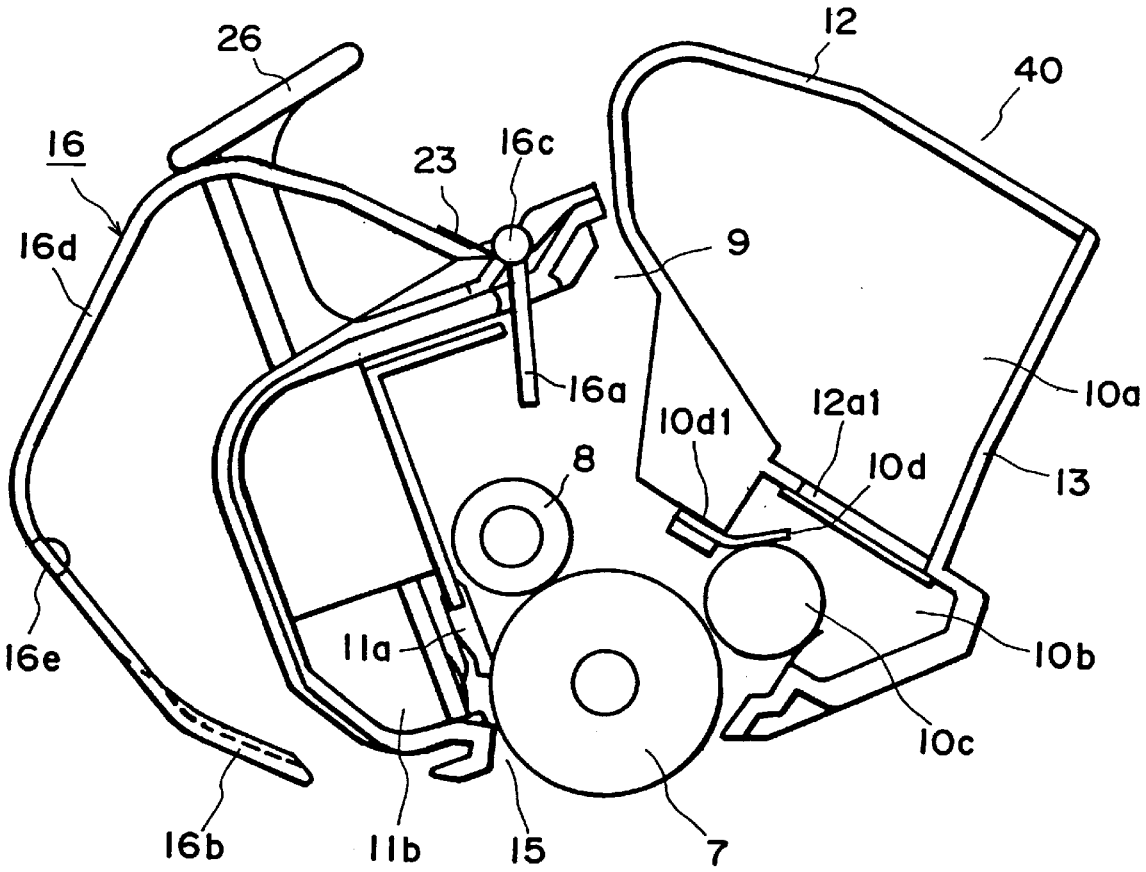
FIG. 10 is a sectional view of the shutter member, which is open.
Figure 11:
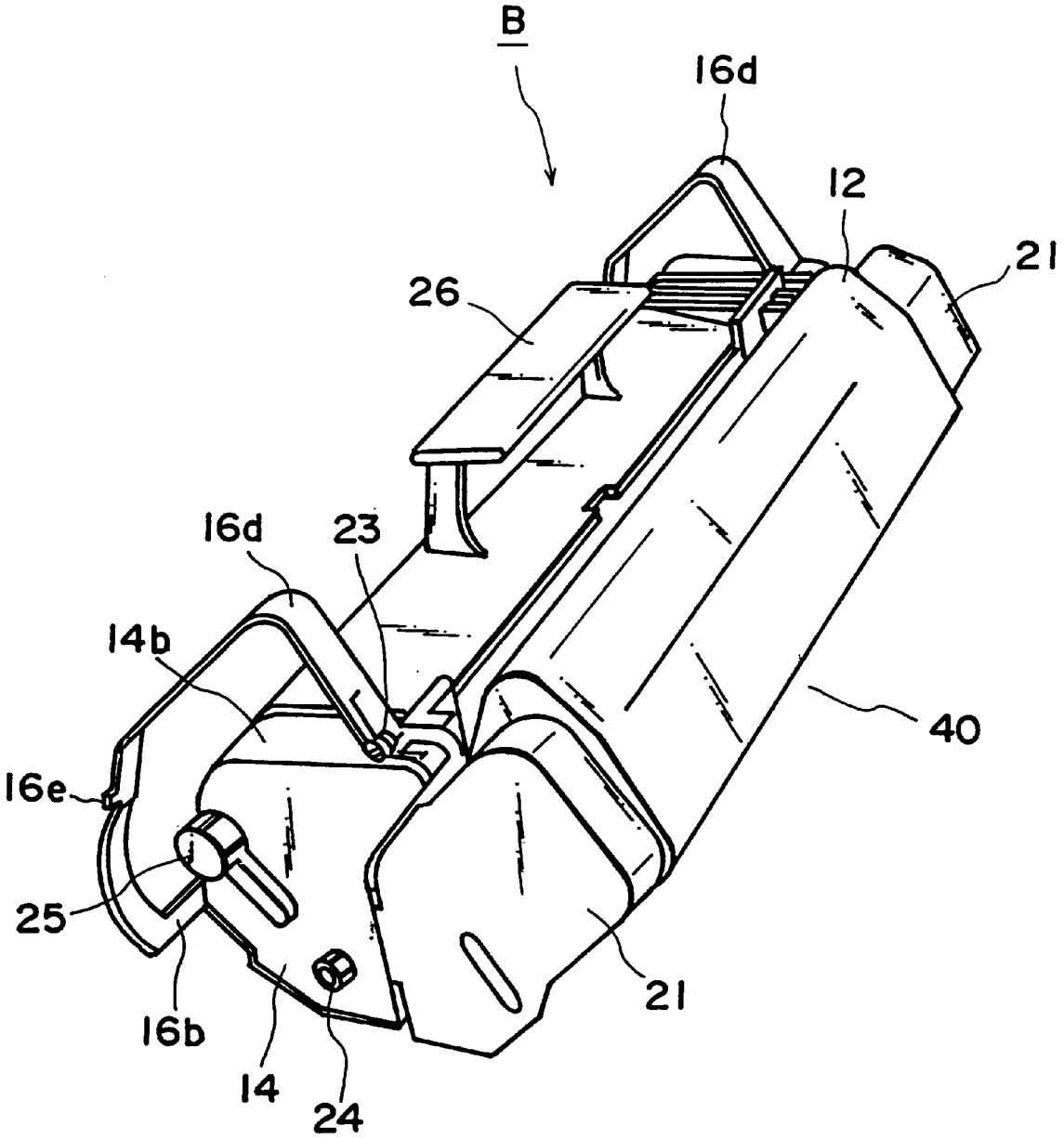
FIG. 11 is a perspective view of the shutter member, which is open.

Next, the shutter structure will be described referring to FIGS. 8–11. FIG. 8 is a perspective view of the shutter member. FIG. 9(*a*) is a plan view of the shutter member as seen from the crosswise direction; FIG. 9(*b*) is a side view of the shutter member as seen from the longitudinal direction. FIG. 10 is a sectional view of the open shutter member. FIG. 11 is a perspective view of the open shutter member.

At the upper portion of the frame of the aforementioned process cartridge B, an exposure opening 9 is provided, and at the bottom portion, a transfer opening 15 for transferring the toner image formed on the photosensitive drum 7 onto the recording medium 2 is provided. These openings 9 and 15 are exposed or covered by the shutter member 16. In the embodiment, which will be described below, both of the openings 9 and 15 are formed by cooperation of the developing means frame 12 and cleaning means frame 14.

Referring to FIGS. 8 and 9, the shutter member 16 integrally comprises the first shutter portion 16*a*, which exposes or covers the exposure opening 9, and the second shutter portion 16*b*, which exposes or covers the transfer opening 15. The damage to the surface of the photosensitive drum 7, adhesion of foreign matter such as dust to the photosensitive drum 7, optical aging of the photosensitive material, and the like, can be prevented by these shutter portions 16*a* and 16*b*.

Referring to FIGS. 9(*a*) and 9(*b*), this shutter member 16 comprises a rotational axis 16*c*, which is provided at each of the longitudinal ends. The first shutter portion 16*a* diagonally extends from the axis 16*c* in the inclined downward direction, and the second shutter portion 16*b* is disposed in such a manner as to bridge two arm portions 16*d*, which extend from the corresponding axes 16*c* in the direction opposite to the shutter portion 16*a*, and then, curve downward and to the right following the contour of the cleaning means frame 14.

Referring to FIG. 2, a bearing section 14*a* with a U-shaped cross-section is provided on the cleaning means frame 14, on the upper portion at each of the longitudinal ends. The rotational axis 16*c* of the shutter member 16 is fitted into this bearing section 14*a*; in other words, the shutter member 16 is mounted so as to be rotatable around the third frame 14. A torsional coil spring 23 is attached to one of the rotational axes 16*c*, which provides a force to pressure constantly the shutter member 16 in the direction of closing the openings 9 and 15.

The U-shaped groove of the bearing section 14*a* is formed in an elastically deformable manner, with its opening being narrower than the groove itself; therefore, the shutter member 16*b* can be simply attached just by snapping in the axis 16*c* from above by force. In other words, the axis 16*c* is retained in the U-shaped bearing section 14*a* by the elasticity of the bearing section, and it can be easily pulled out of the bearing section 14*a*.

An engagement projection 16*e* is provided at a predetermined location of the aforementioned arm portion 16*d*. As the process cartridge B is inserted into the image forming apparatus A as will be described later, the engagement projection 16*e* engages with the engagement portion 13*a* of the main assembly of the apparatus A, whereby the shutter member 16 is rotated about the axis 16*c*. As a result, the first shutter portion 16*a* exposes the exposure opening 9, and at the same time, the second shutter portion 16*b* exposes the transfer opening 15.

More specifically, the projection 16*e* is provided on the lateral end of the arm portion 16*d*, which is one of the arm portions. As the process cartridge B is installed into the main assembly of the apparatus A, the projection 16*e* comes in contact with the engagement portion 13*a* provided on the main assembly of the apparatus A, and engages with it, being thereby subjected to a force which works in the direction of opening the shutter member 16. It should be noted here that the projection 16*e* projects outward in the axial direction of the photosensitive drum.

The first shutter portion 16*a*, which exposes or covers the exposure opening 9, and the second shutter portion 16*b*, which exposes or covers the transfer opening 15, are integrally formed as described above. Therefore, it is unnecessary to employ a complicated link mechanism, which not only allows the reduction in the component count of the shutter member 16, but also simplifies the assembly process of the shutter member 16. Further, the shutter member can be more reliably opened or closed.

Referring to FIG. 11, the arm portion 16*d* is made of thin plate material, and is formed to follow the external contour of the cleaning means frame 14. At the longitudinal lateral end portion of the cleaning means frame 14, a recessed portion 14*b* is formed, the depth of which matches the thickness of the arm portion 16*d*. Therefore, when the shutter member is in the closed state, the arm portion 16*d* is fitted in the recessed portion 14*b*, with the external surface of the arm portion being substantially level with the external surface of the cleaning means frame 14.

With the above described arrangement, the arm portion 16*b* does not project from the cartridge frame in the longitudinal direction, nor above the external surface of the cleaning means frame. Therefore, not only can the cartridge B size be reduced in the longitudinal direction, but also, its overall size can be reduced.

Referring to FIG. 1, as the process cartridge B of this embodiment is installed into the image forming apparatus A, the shutter member 16 is rotated, whereby the second shutter portion 16*b* is moved to a position above the fixing means 5. This fixing means 5, which contains a heater, generates heat, but an air passage is created between the second shutter portion 16*b* and cleaning means frame 14, allowing thereby the air heated by the fixing means 5 to flow upward; therefore, the heat generated by the fixing means 5 can be easily discharged to prevent an internal temperature increase of the apparatus.

Further, the shutter member 16 comprises reinforcing ribs 16*f*, which are provided on the edge of the arm portion 16*d*, and edges, or their adjacencies, of the shutter portions 16*a* and 16*b*.

As described above, the shutter member 16 of this embodiment comprises the first and second shutter portions 16*a* and 16*b*, and axis 16*c*, which are integrally formed. The axis 16*c* is the rotational center, about which the shutter member 16 attached to the cleaning means frame 14 rotates, and also, is the engagement portion, with which the shutter member 16 is attached to the cleaning means frame 14. The second shutter portion 16*b* is connected to the axis 16*c* with the arm portion 16*d*, wherein the configuration of the arm portion 16*d* is such that it matches the contour of the external wall surface of the process cartridge B when the shutter member 16 is mounted on the cleaning means frame 14. The arm portion 16*d* is located at each of the longitudinal ends of the second shutter portion 16*b*. The shutter member 16 is a single piece component of plastic material (for example, highly impact resistant styrene or the like). In other words, the first and second shutter portions 16*a* and 16*b*, axis 16*c*, arm portion 16*d*, projection 16*e*, and ribs 16*f* are integrally formed of plastic material.

{Structure for Installing or Removing Cartridge}

Figure 12:
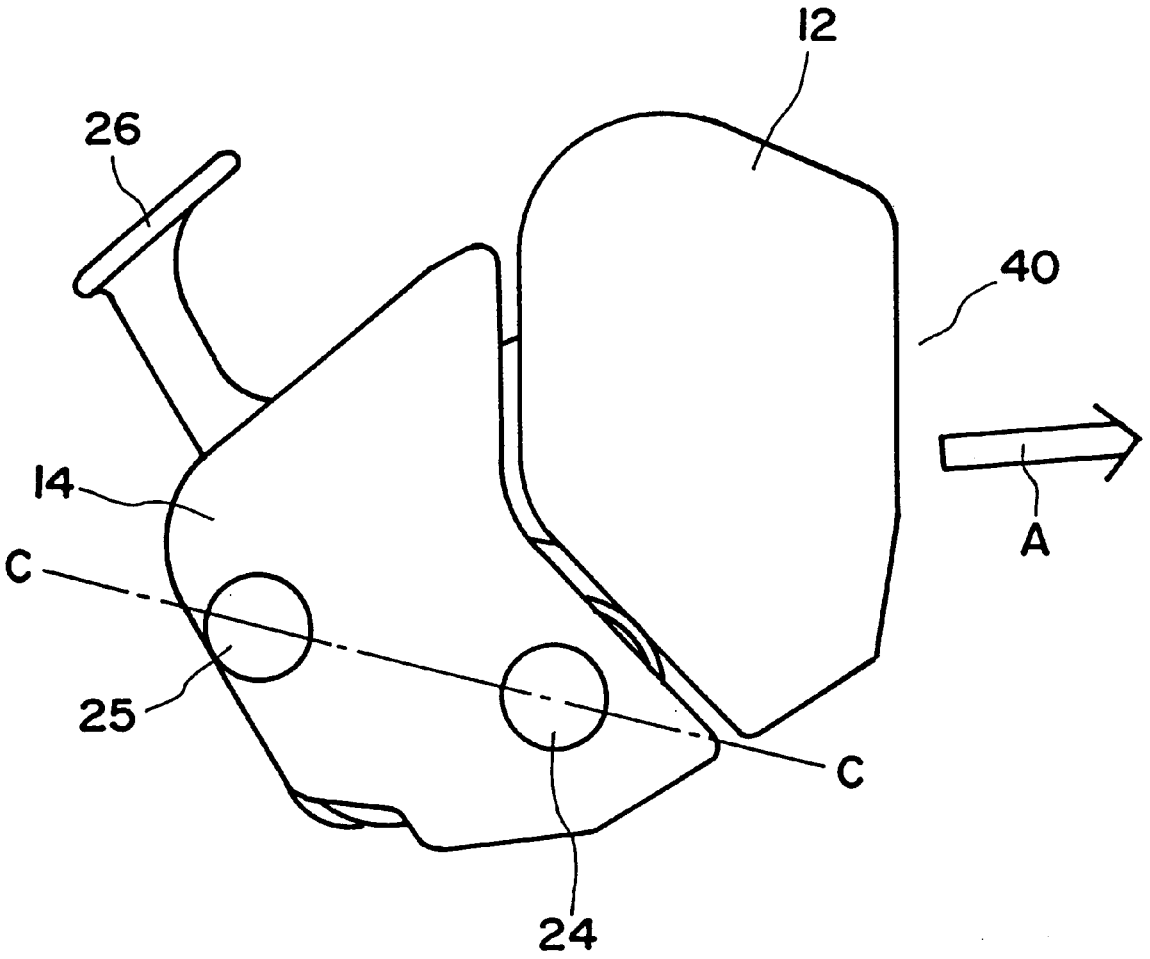
FIG. 12 is a side view of the process cartridge.
Figure 13:
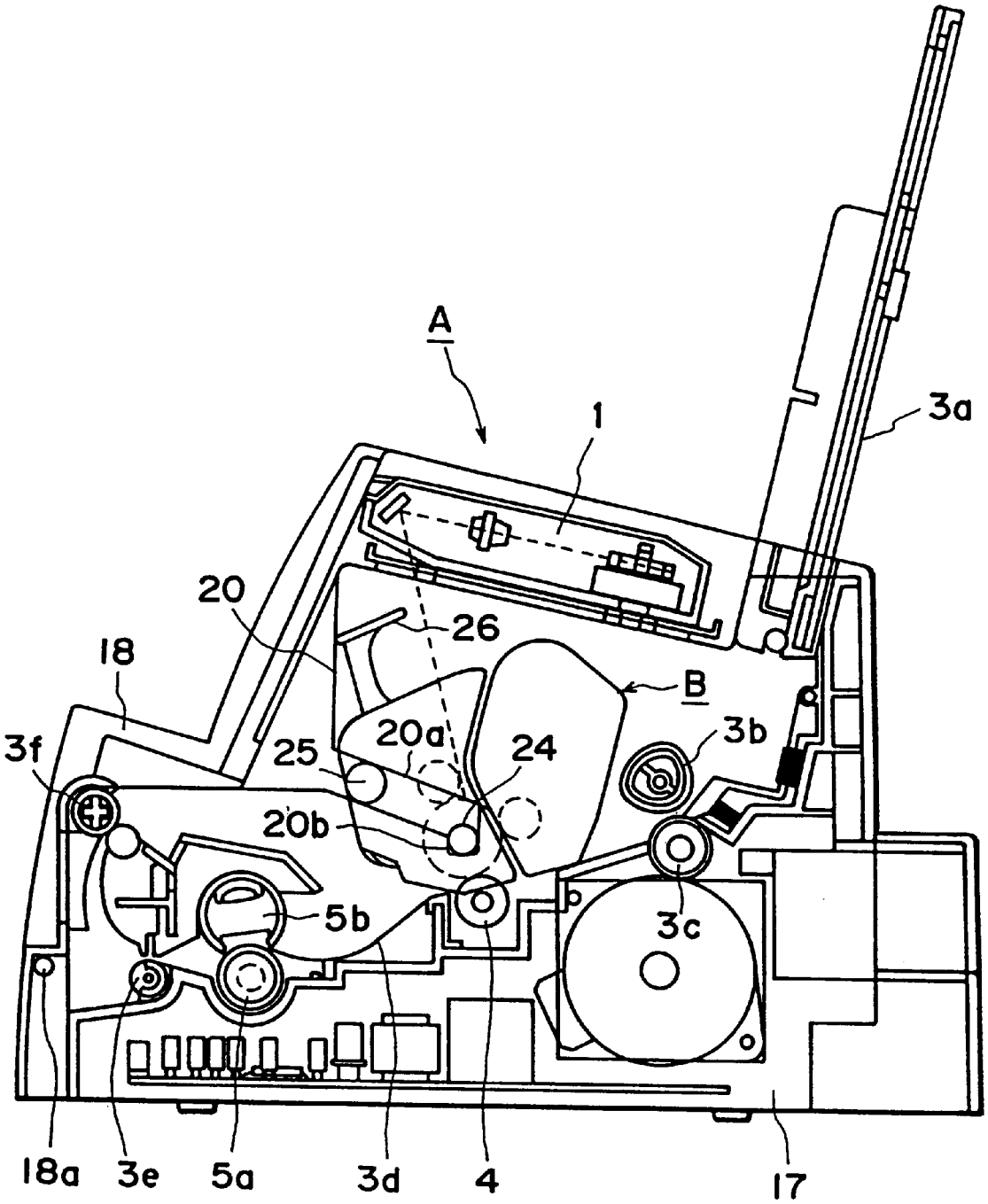
FIG. 13 is a sectional view of a portion that serves as a guide during the cartridge installation.
Figure 14:
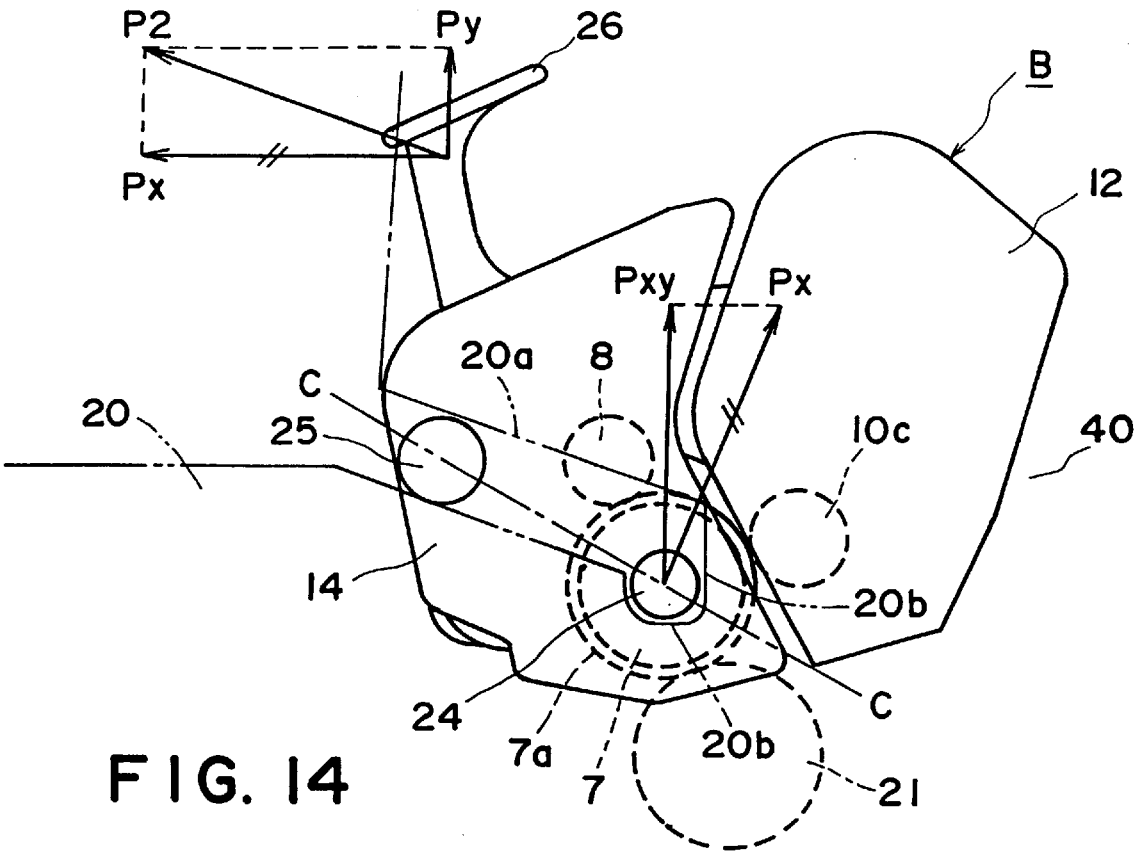
FIG. 14 is an explanatory drawing, which depicts how the process cartridge is removed from the image forming apparatus, wherein the first projection is in engagement with a recessed portion.
Figure 15:
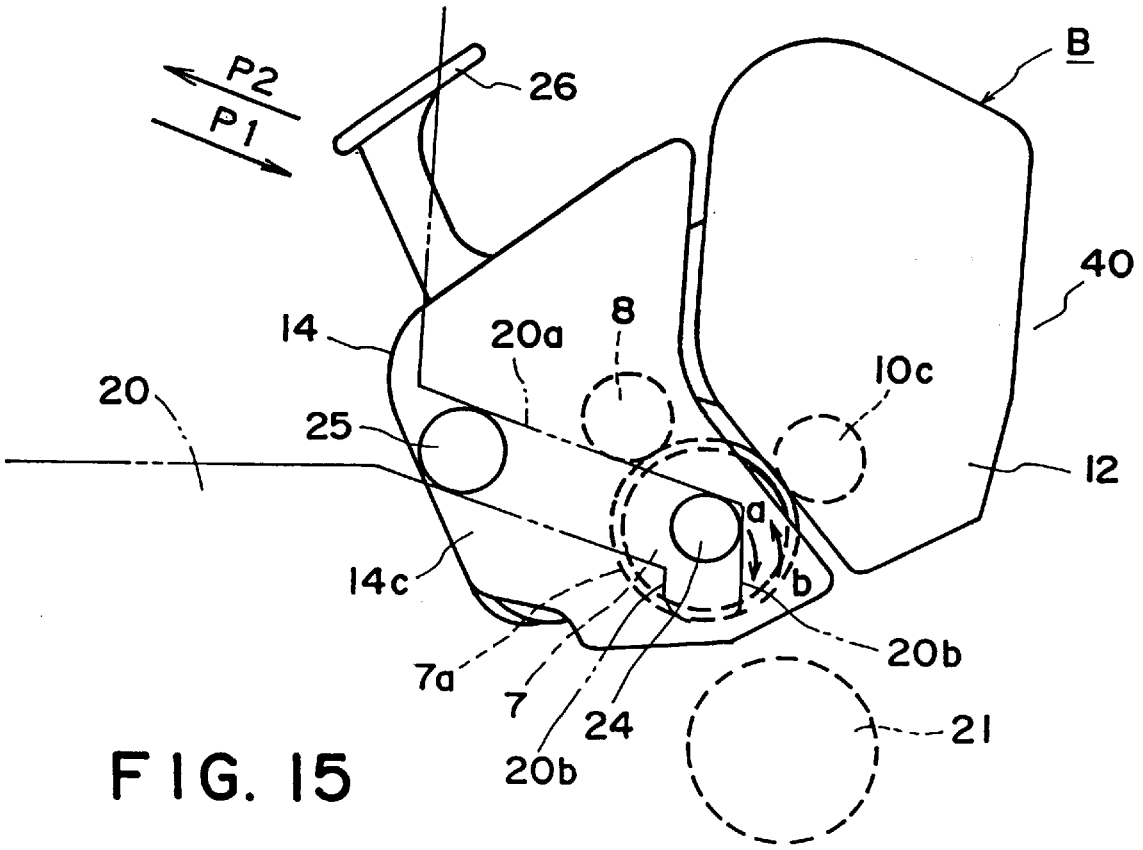
FIG. 15 is an explanatory drawing, which depicts how the process cartridge is removed, wherein the process cartridge has been rotated about the second projection by pulling a knob.
Figure 16:
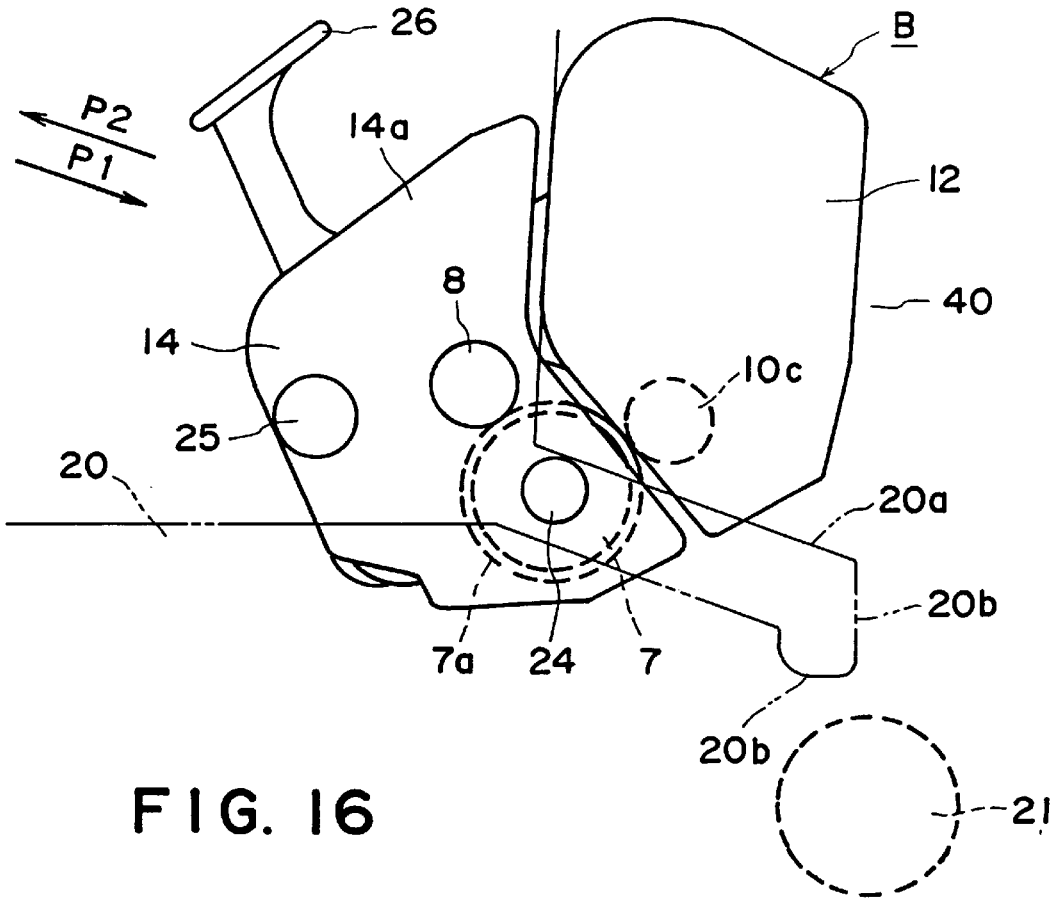
FIG. 16 is an explanatory drawing, which depicts how the process cartridge is removed, wherein the process cartridge is being pulled out by pulling the knob.
Figure 17:
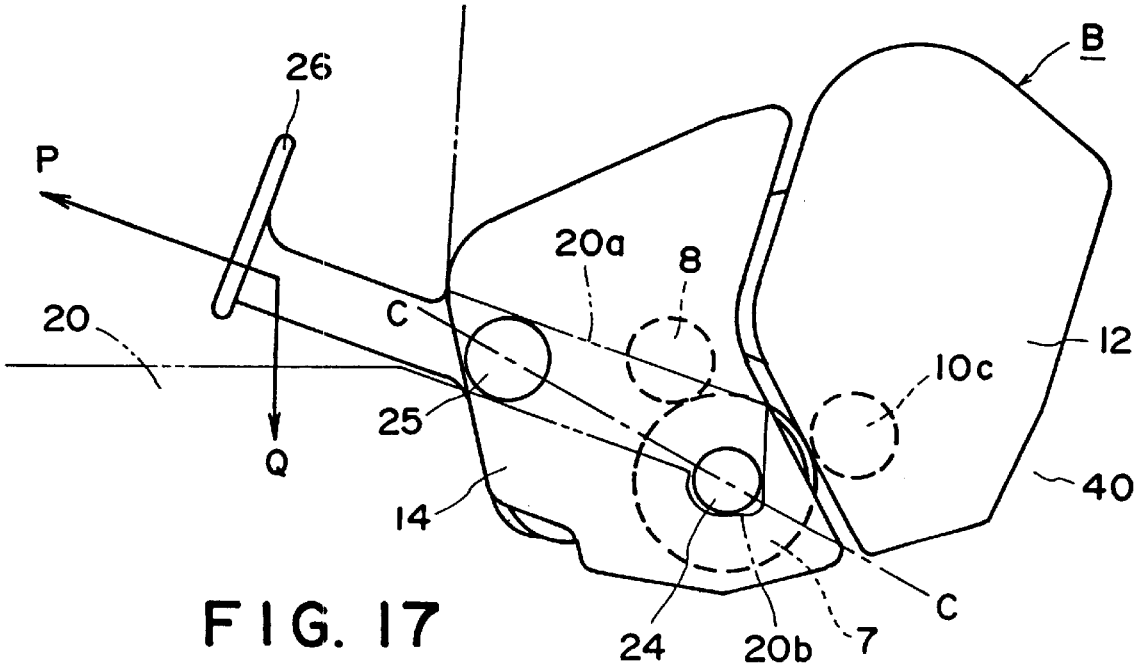
FIG. 17 is a sectional view of a different type of process cartridge, the knob of which is not provided on the top.

Referring to FIG. 4 and FIGS. 12–17, the structure for installing the process cartridge B into the image forming apparatus A, or removing it therefrom, will be described. FIG. 12 is a side view of the process cartridge. FIG. 13 is a sectional view of a cartridge installation guide. FIGS. 14–16 are explanatory drawings for depicting how the cartridge B is taken out. FIG. 17 is an explanatory drawing for depicting how the cartridge B, which has a knob disposed at a position other than on the top, is removed.

In FIGS. 14–16, alphanumeric references P1 and P2 designate the directions in which the process cartridge B is installed into, or removed from, the apparatus main assembly, respectively. In this embodiment, the process cartridge B is installed into, or removed from, the apparatus main assembly in the direction perpendicular to the axial direction of the photosensitive drum 7 as shown in FIG. 4, with the developing means frame 40 side being placed to the front and the cleaning means frame 14 side being at the rear.

Referring to FIG. 12, the process cartridge B comprises a first projection 24, which is disposed at each of the longitudinal end surfaces of the cleaning means frame 14 to fix the position of the cartridge B, and a second projection 25, which maintains the orientation of the cartridge B. The first projection 24 is in line with the rotational axis of the photosensitive drum 7, and the second projection 25 is located behind the first projection 24 relative to the direction P1, in which the process cartridge B is installed into the apparatus A.

Further, the cleaning means frame 14 of this embodiment has a knob 26, which is integrally formed with the cleaning means frame 14. The knob 26 is disposed so as to be positioned above a line C—C, which connects the centers of the first and second projections 24 and 25.

On the other hand, the image forming apparatus A is provided with a cover 18, which is pivotally opened or closed about the axis 19. As the cover 18 is opened (FIG. 4), a space reserved in apparatus main assembly for accommodating the cartridge is exposed, wherein an installation guide member 20 as the cartridge installing means, such as the one shown in FIG. 13, is provided at each of the lateral sides of the space. This guide member 20 has a guide groove 20*a*, which extends in the diagonally downward direction to guide the first and second projections 24 and 25 of the process cartridge B, and at the bottom end of the guide groove 20*a*, a positioning recess 20*b* is provided.

Referring to FIG. 16, first, an operator grabs the knob 26 and engages the first projection 24, which is provided at each of the longitudinal end surfaces of the process cartridge B, into the groove 20*a*. Next, as the operator inserts the process cartridge B further into the image forming apparatus A along the groove 20*a*, the second projection 25 provided at each of the longitudinal end surfaces of the process cartridge B engages with the groove 20*a*. Then, the process cartridge B is further inserted along the groove 20*a* with the first and second projections 24 an 25 being engaged in the groove 20*a*. As the process cartridge B is inserted to the deepest point, the first projection 24 comes in contact with the wall 20*b* at the deepest end of the groove 20*a* as shown in FIG. 15. Then, the process cartridge B is slightly rotated by its moment in the clockwise direction (in the direction of an arrow a in FIG. 15) about the second projection 25. As a result, the first projection 24 drops into the recess 20*b*, fixing thereby the position of the process cartridge B, which concludes the installation of the process cartridge B. The orientation of the process cartridge in the apparatus A is maintained by the second projection, which is in engagement with the guide groove 20*a*. Further, the process cartridge B rotates only slightly to drop into the recess 20*b*; therefore, when a helical gear 7*a* provided at one of the longitudinal ends of the photosensitive drum 7 meshes with a helical gear 21 provided on the main assembly of the apparatus A, the gears are not likely to be damaged. Further, since the process cartridge B is rotated upward when it is removed from the main assembly of the apparatus A, the gears can be smoothly disengaged. The helical gear 21 transmits the driving force of a motor (unillustrated) provided on the apparatus main assembly to the photosensitive drum 7.

Next, steps for taking the process cartridge B out of the image forming apparatus in order to exchange the process cartridge B will be described.

When an attempt is made to simply pull the cartridge B out of the apparatus A, it is not going to be successful since the first projection 24 is in engagement with the recess 20*b*. Therefore, it is necessary to dissolve the engagement between the first projection 24 and positioning recess 20*b* before attempting to pull out the cartridge B. According to this embodiment, this state of engagement can be released in relation to the action for simply pulling out the cartridge B.

More specifically, as the operator pulls the knob 26 of the process cartridge B of this embodiment toward him/her in order to remove the process cartridge B, the process cartridge B is rotated counterclockwise (in the direction of an arrow b in FIG. 15) about the second projection 25, whereby the engagement between the projection 24 and recess 20*b* is simply broken. In other words, as the knob 26 is pulled in the arrow P2 direction as shown in FIG. 14, a force equivalent to an x-component Px of the force P2 is imparted on the first projection 24, generating thereby a rotational moment about the second projection 25, and at the same time, the first projection 24 is lifted by a y-component Pxy of the force Px, whereby the engagement between the projection 24 and positioning recess 20*b* is broken as shown in FIG. 15. In this state, the knob 26 is pulled in the arrow P2 direction, whereby the process cartridge B can be pulled out with the first and second projections 24 and 25 sliding along the guide groove 20*a*.

In other words, the operator can simply take the process cartridge B out of the image forming apparatus A just by pulling the knob 26 in the arrow P2 direction.

On the contrary, when the knob 26 is disposed below the line C—C connecting the centers of the first and second projections 24 and 25 as shown in FIG. 17, the process cartridge B does not rotate about the second projection 25 even if the operator pulls the knob 26 in the arrow P2 direction. Therefore, the engagement between the first projection 25 and positioning recess 20*b* is not broken. In such a case, the process cartridge B cannot be taken out unless the projection 26 is pushed down in the direction of an arrow Q to break the engagement between the projection 24 and recess 20*b*, and then, is pulled in the arrow P direction.

It is easily understandable from the above description that the structure of this embodiment, in which the knob 26 is disposed above the line C—C connecting the centers of the first and second projection 24 and 25, is advantageous since the process cartridge B can be simply taken out just by applying a force to the process cartridge B in the direction in which the cartridge B is taken out.

Further, forming integrally the first and second projections 24 and 25, and the knob 26 on the same member, that is, the cleaning means frame 14, can improve accuracy in the positional relationship among the components, eliminating thereby the loose fit associated with the first and second projection 24 and 25, and the knob 26.

{Other Embodiments}

Next, referring to FIGS. 18–20, the other embodiments of the present invention will be described regarding: (1) Frame structure of the developing means; (2) Shutter structure; and (3) Structure for installing or removing the cartridge, in this order, and then, (4) Structures of various other components will be described, wherein the components having the same functions as those of the first embodiment will be designated with the same reference symbols to eliminate the duplication of the description.

{Other Embodiments of Frame Structure of Developing Means}

In the first embodiment, when the frame member 12 and wall member 13 is joined, only the joint between the frame member 12 and toner chamber wall portion 13*a* is melt-welded, and the end member 21 is attached at each of the longitudinal end surfaces of both frame and wall members in order to fix the positional relationship between two components 12 and 13 (refer to FIG. 7). However, the frame member 12 and wall member 13 may be joined by melt-welding the entire lenght of the joint between the two members 12 and 13.

With such an arrangement, the two members 12 and 13 are more firmly joined, which can prevent the component displacement caused by torsional force. In this case, it is unnecessary to interpose the toner leak prevention seal 22 at the joint where the developing chamber wall portion 13*b* of the wall member 13 is joined with the frame member 12. Therefore, the component count can be reduced, which in turn reduces the assembly steps.

Further, in the first embodiment, the seal mounting portion 12*a* is provided on the frame member 12, and the sealing member 27 is mounted on this seal mounting portion 12*a* by gluing, melt-welding, or the like means to seal the toner supplying opening 12*a*1. However, the sealing member 27 may be simply pinched as shown in FIG. 18.

Figure 18:
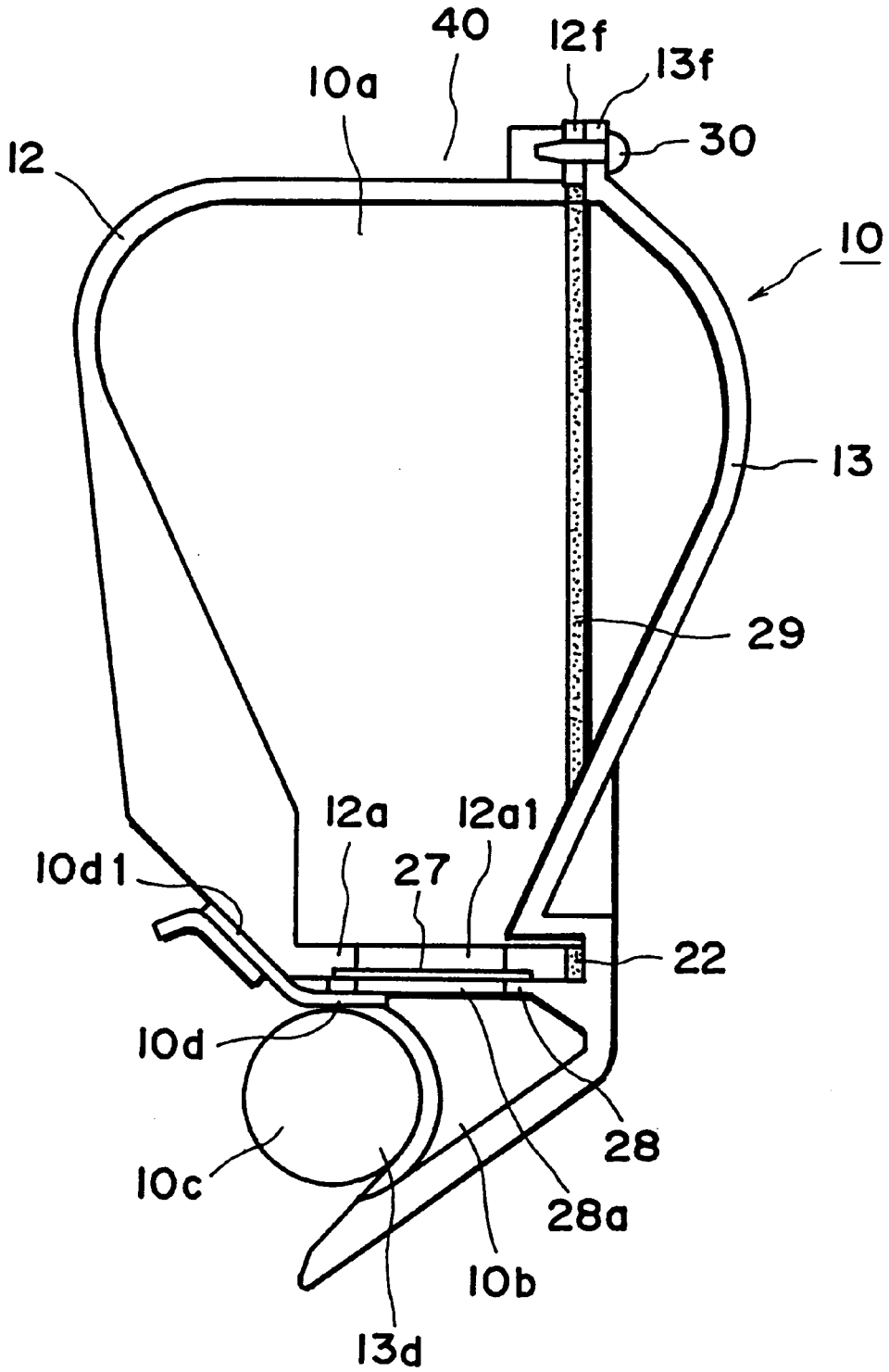
FIG. 18 is a sectional view of another embodiment of developing means, which comprises a seal retaining portion.

The frame member 12 illustrated in FIG. 18 comprises the seal mounting portion 12*a* with the toner supplying opening 12*a*1, which is similar to the arrangement in the first embodiment. However, in this embodiment, a seal retaining portion 28, which can join with the seal mounting portion 12*a* when the frame and wall members 12 and 13 are joined, is provided on the wall member 13, between the toner chamber wall 13*a* and developing chamber wall 13*b*. This seal retaining portion 28 is provided with a toner supplying opening 28*a*, the size and location of which coincides with those of the toner supplying opening 12*a*1.

The frame member 12 and wall member 13 are joined with small screw 30 with the interposition of a toner leak prevention seal 29, which is composed of foamed polyurethane or the like, at the interface.

The sealing member 27 is retained at a predetermined location by being interposed between the seal mounting portion 12*a* and seal retaining portion 28 when the frame member 12 and wall member 13 are joined. Therefore, it is unnecessary to attach the sealing member 27 by gluing, melt-welding, or the like means, which makes it easier to remove the sealing member 27 when the cartridge usage begins, and also, makes it easier to recycle the frame member 12 and wall member 13 since they are not contaminated with adhesive residue, welding residue, or the like.

Further, regarding the provision of the seal retaining portion 28 on the wall member 13, a hinge portion 31 may be provided at the border portion between the toner chamber wall portion 13*a* and developing chamber wall portion 13*b* to permit hinge motion.

Figure 19:
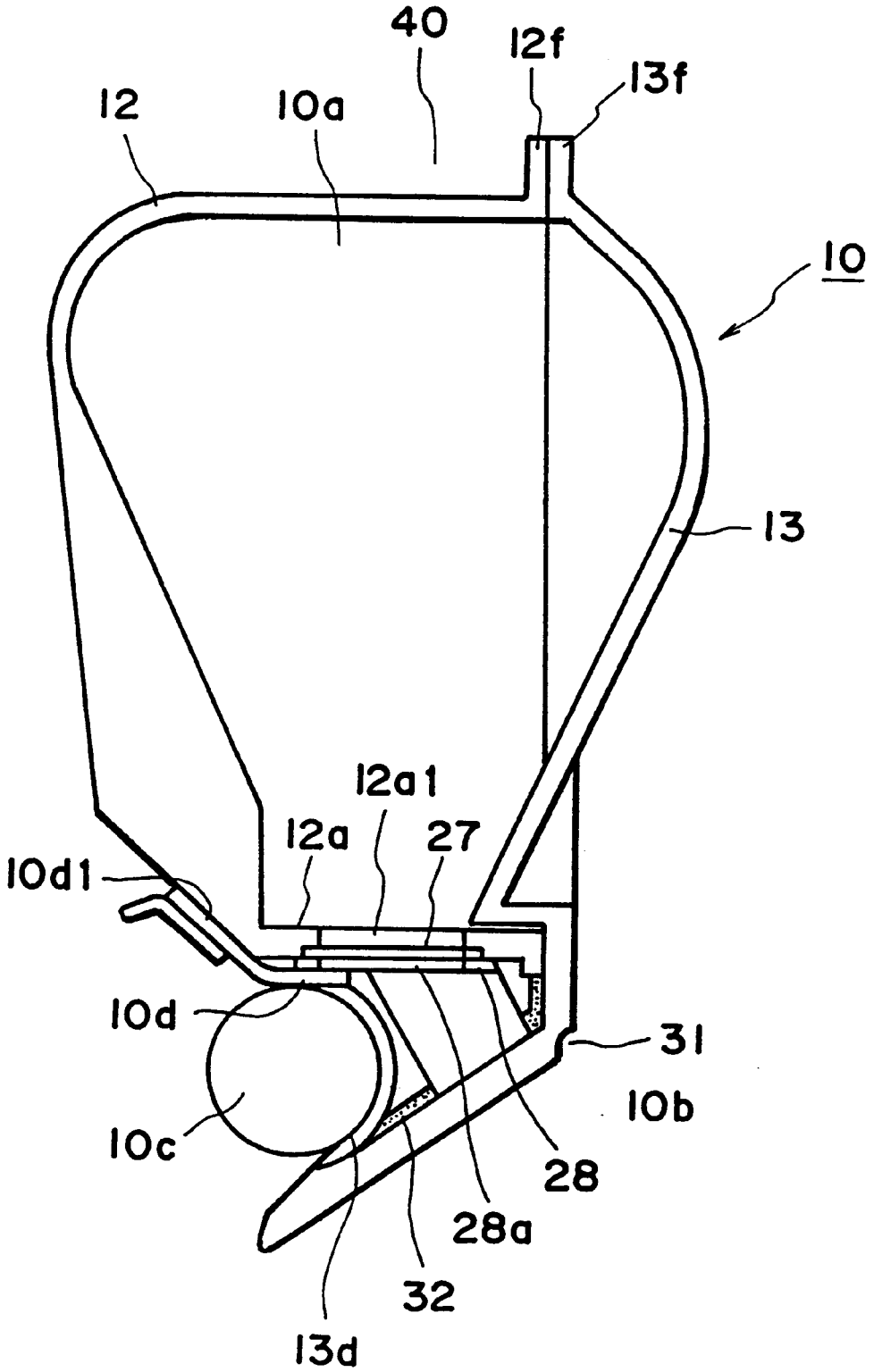
FIG. 19 is a sectional view of another embodiment of developing means, in which the wall member is provided with a hinge portion.

The structure illustrated in FIG. 19 is different from that illustrated in FIG. 18 in that there is a bendable hinge portion 31 between the toner chamber wall portion 13*a* and developing chamber wall portion 13*b* of the wall member 13, and that when the frame member 12 is joined with the wall member 13, the joint between the frame member 12 and toner chamber wall portion 13*a* is melt-welded, but a toner leak prevention seal 32 composed of foamed polyurethane or the like is interposed at the joint between the frame member 12 and developing chamber wall portion 13*b*.

In this case, the sealing member 27 can be simply pinched between the seal mounting portion 12*a* and seal retaining portion 28 just by bending the developing chamber wall portion 13*b* after melt-welding the joint between the frame member 12 and the toner chamber wall portion 13*a* of the wall member 13 during the assembly of the cartridge.

In the case of such a design as described above in which the wall member 13 is provided with the hinge portion 31, the position of the toner chamber wall portion 13*b* is fixed in a state of being bent at the hinge portion 31. Therefore, it is necessary to maintain the angle of the hinge portion 31 by attaching the end member 21 with the positioning bosses, at each of the longitudinal ends of the frame and wall members 12 and 13, after joining them in the same manner as the first embodiment.

Hereinbefore, the frame structure of the developing means was described with reference to the process cartridge including the one in the first embodiment, but such a structure is similarly applicable to developing apparatuses comprising a toner chamber, and a developing chamber in which a developing roller, a developing blade, and the like, are mounted, and the same effects can be expected.

{Other Embodiments of Shutter Structure}

In the case of the first embodiment described above, the shutter member 16 is made of a single piece comprising integrally the first shutter portion 16*a*, which exposes or covers the exposure opening 9, and the second shutter portion 16*b*, which exposes or covers the transfer opening 15 (refer to FIGS. 8 and 9). However, the first and second shutter portions 16*a* and 16*b* may be separate members as shown in FIG. 20.

Figure 20:
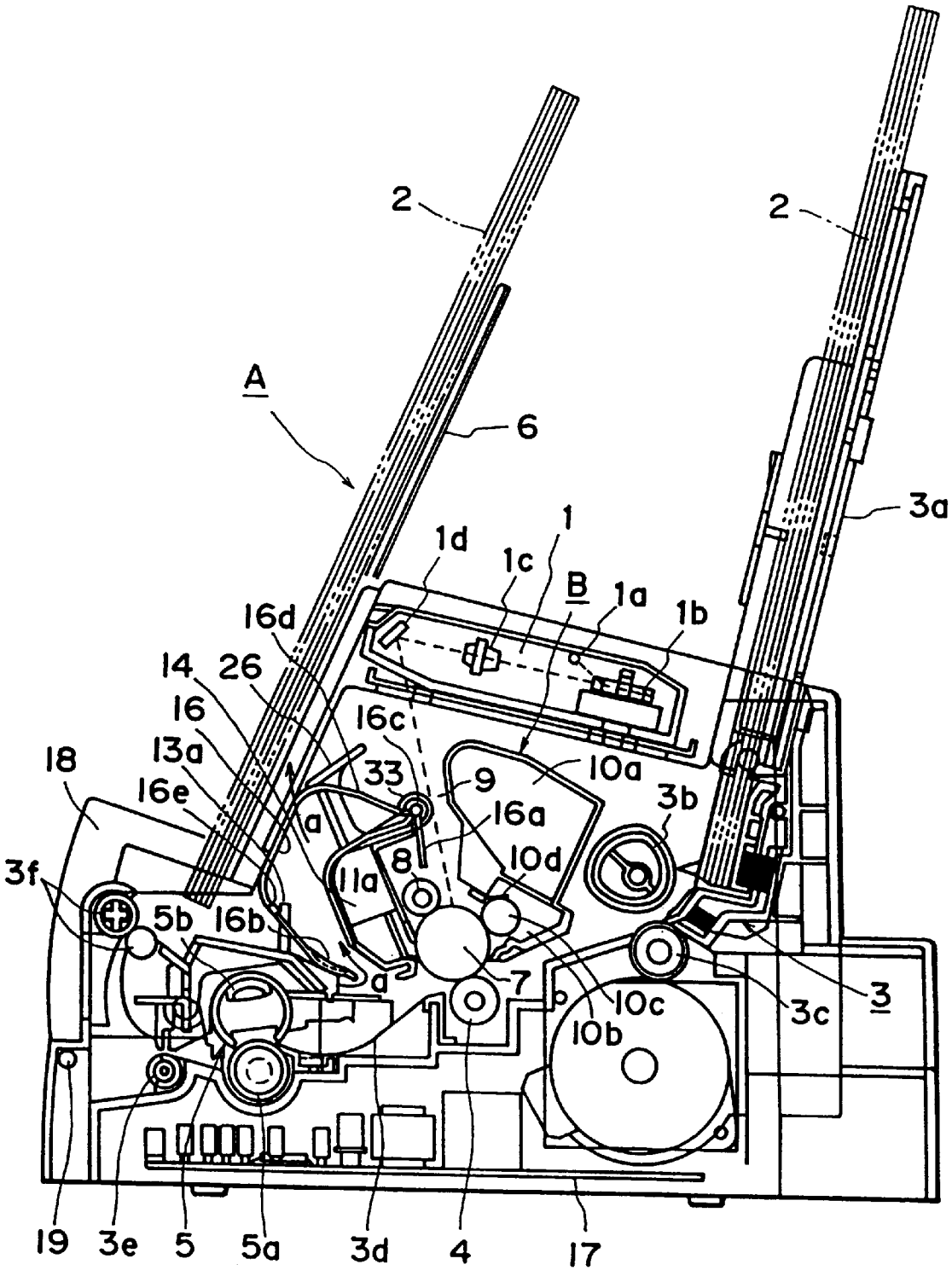
FIG. 20 is a sectional view of another embodiment of shutter, in which the first and second shutter portions are interlocked with a link portion.

In the case of the shutter structure illustrated in FIG. 20, the first shutter portion 16*a*, which exposes or covers the exposure opening 9, and the second shutter portion 16*b*, which exposes or covers the transfer opening 15, are separate members, both of which are rotatively supported by the bearing portions provided the top portion of the cleaning means frame 14, and are under a constant pressure, which is generated by an unillustrated spring in the closing direction.

As for the opening or closing means of the first shutter portion 16*a*, an arc-shaped link portion 33 is provided, which is integrally formed with the second shutter portion 16*b*. Therefore, as the second shutter portion 16*b* is opened, the link portion 33 moves together to push down the first shutter portion 16*a*, opening thereby the first shutter portion 16*a*. As the second shutter portion 16*b* is closed, the link portion 33 ceases holding down the first shutter portion 16*a*, allowing thereby the first shutter portion 16*a* to close.

Also, the above described structure makes it possible to interlock the opening or closing movement of the first shutter portion 16 with the opening or closing movement of the second shutter portion 16*b*. Therefore, the shutter portions can be reliably opened or closed without the provision of a complicated mechanism for opening or closing the shutter portions.

Even in the case of the structure illustrated in FIG. 20, the second shutter portion 16*b* is formed so that its arm portion 16*d* does not project beyond the longitudinal end portions of the cartridge frame, and the second shutter portion 16*b* forms the air passage for releasing the heat generated by the fixing means 5. Therefore, the same effects as the first embodiment can be expected.

{Other Embodiments of Structure for Installing or Removing Cartridge}

In the first embodiment, the removal of the process cartridge B from the image forming apparatus A is made easier by providing the cleaning means frame 14 with: the first and second projections 24 and 25, which are disposed on each of the longitudinal end surfaces; and the knob 26, which is disposed above the line connecting the projections 24 and 25, wherein, as the knob 26 is pulled, the cartridge B is rotated about the second projection, whereby the engagement between the first projection 24 and the recess portion 20*b* is broken (refer to FIG. 14).

However, when the process cartridge B is to be removed, the operator can break the engagement between the first projection 24 and recess portion 20*b* by holding the cartridge frame instead of the knob 26 and rotating the cartridge B about the second projection 25. After the engagement is broken, the cartridge B can be easily pulled out.

In other words, the process cartridge B can be taken out without the provision of the knob 26, just by rotating the process cartridge about the second projection 25.

Next, another embodiment of a process cartridge B will be described.

Figure 21:
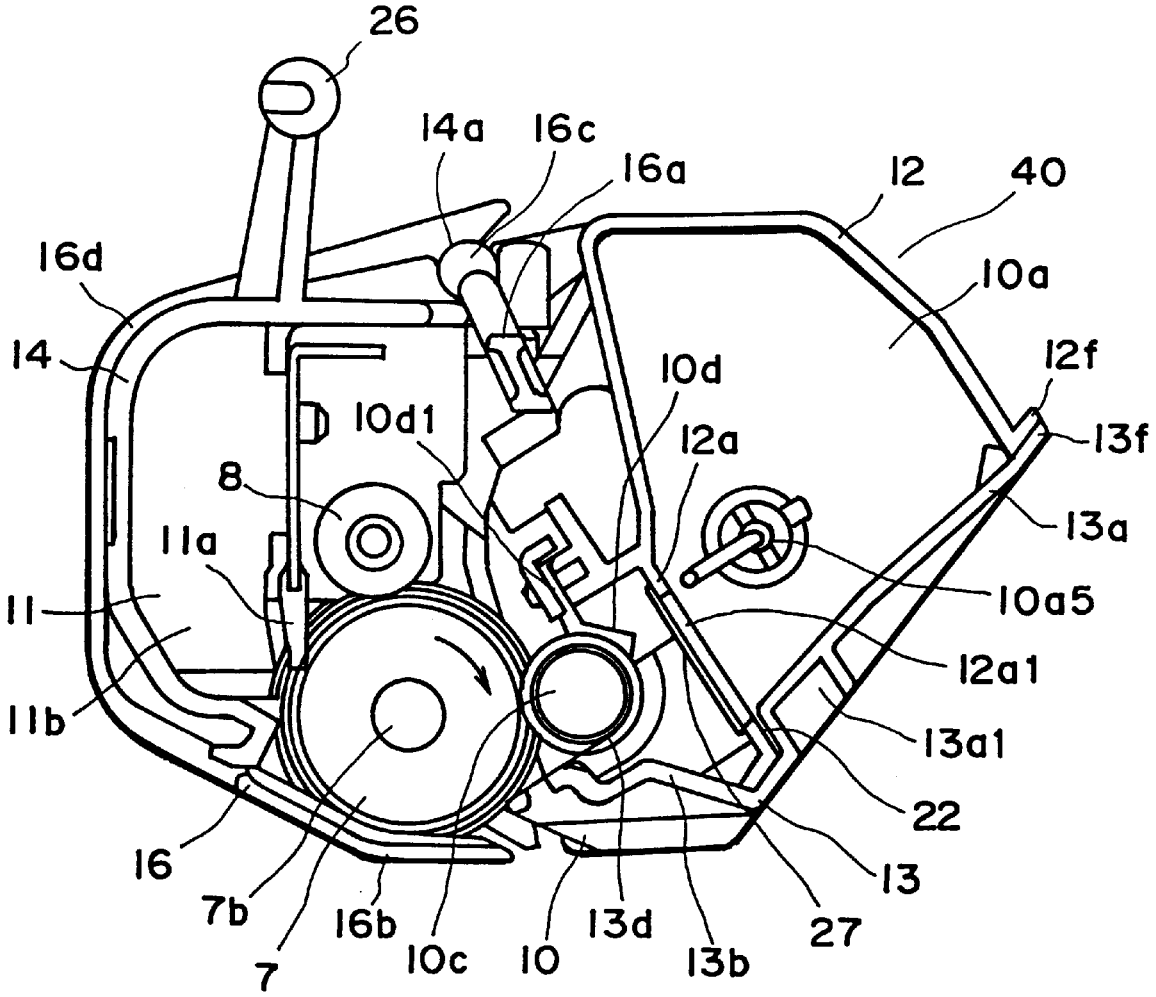
FIG. 21 is a sectional side view of another example of the process cartridge in accordance with the present invention.
Figure 22:
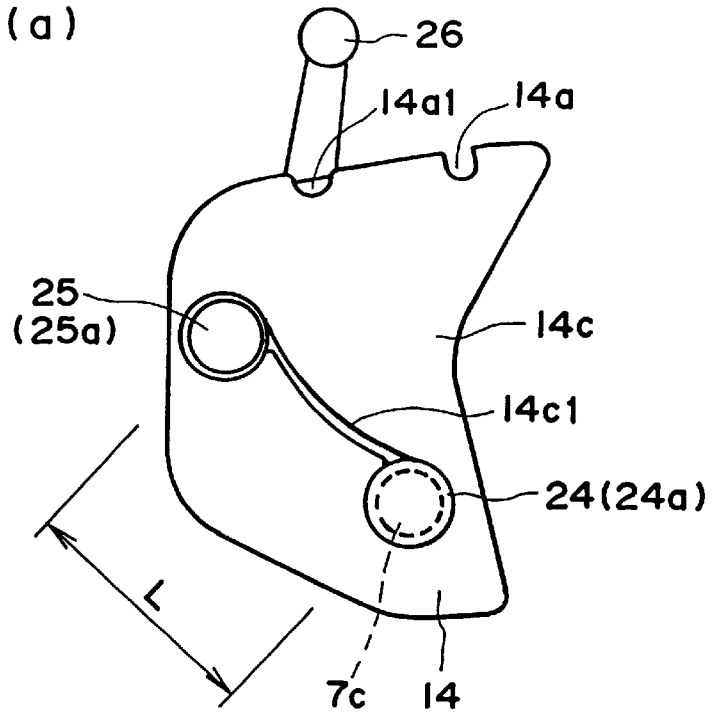
FIG. 22(*a*) is a left side view of the cleaning means frame of the process cartridge illustrated in FIG. 21, and FIG. 22(*b*) is a right side view of the cleaning means frame of the same.
Figure 22:
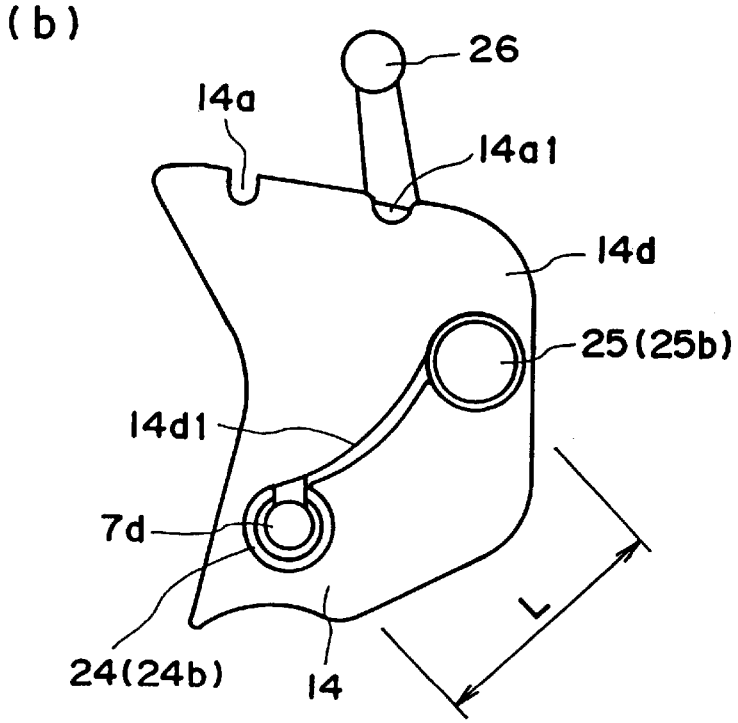
Figure 23:
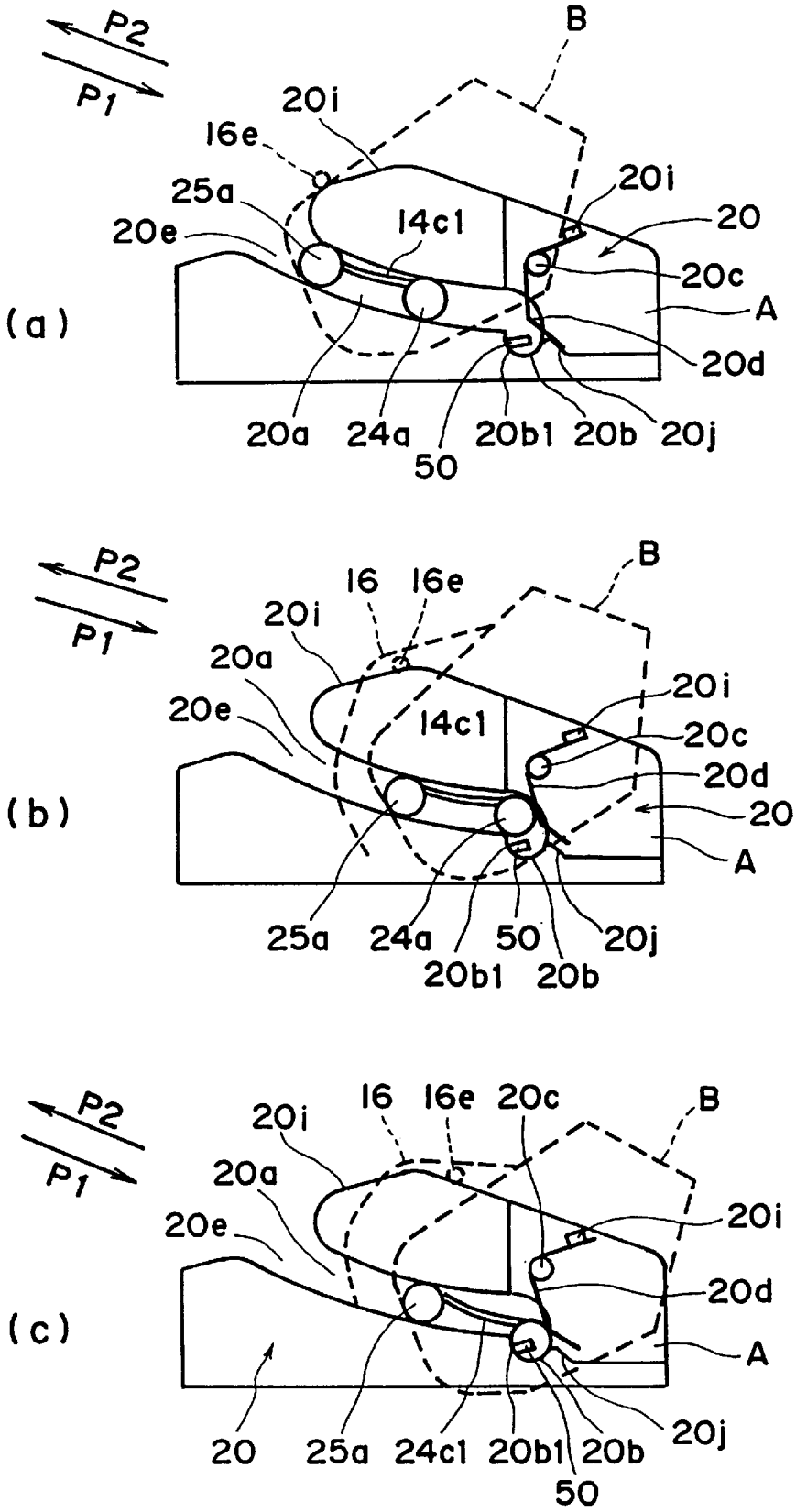
FIGS. 23(*a*), 23(*b*), and 23(*c*) are explanatory drawings, which depict how the process cartridge illustrated in FIG. 21 is installed into, or removed from, the main assembly of the image forming apparatus.
Figure 24:
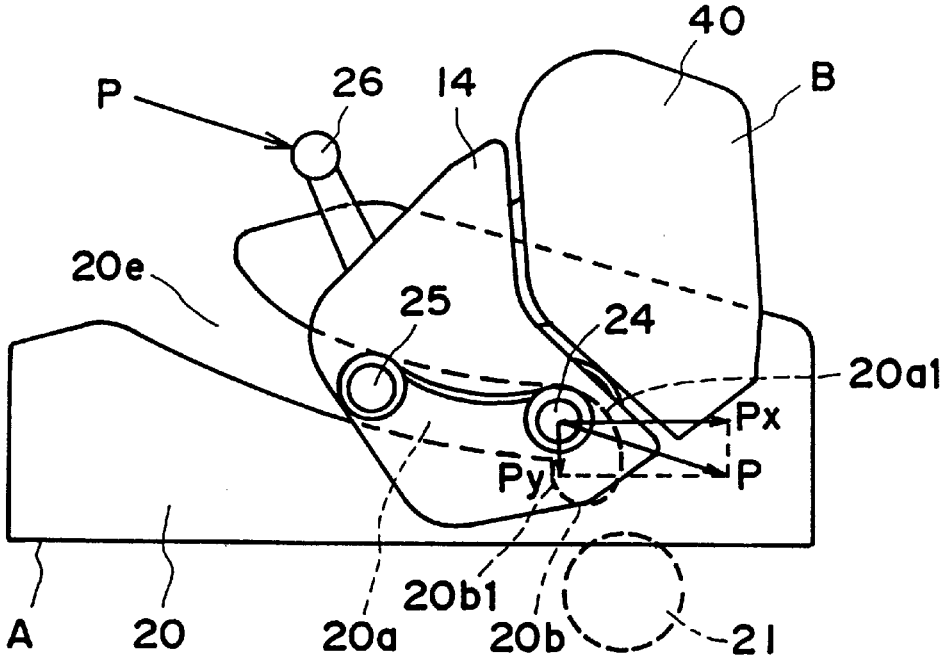
FIG. 24 is an explanatory drawing, which depicts the moment that works when the process cartridge illustrated in FIG. 21 is installed into the apparatus main assembly.
Figure 25:
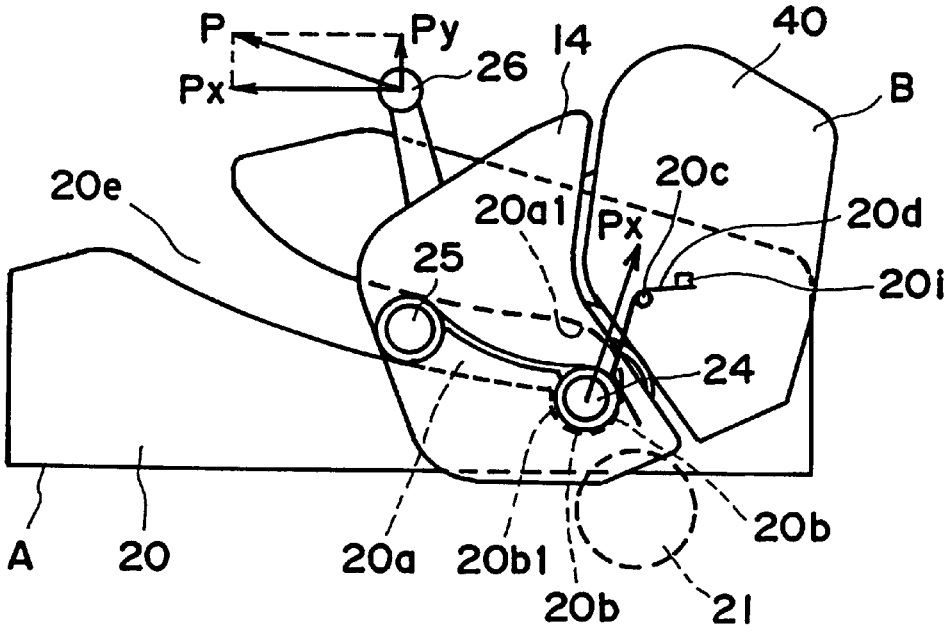
FIG. 25 is an explanatory drawing, which depicts the moment that works when the process cartridge illustrated in FIG. 21 is removed from the apparatus main assembly.

FIG. 21 is a cross-sectional view of another embodiment of the process cartridge B. FIG. 22(*a*) is a left side view of the cleaning means frame 14 of the process cartridge B; FIG. 22(*b*) is a right side view thereof. FIG. 23 is an explanatory drawing depicting how the process cartridge according to the present invention is inserted into, or removed from, an electro-photographic image forming apparatus. FIG. 24 is a side view of the process cartridge, describing the moment working during the cartridge insertion. FIG. 25 is a side view of the process cartridge, describing the moment working during the removal thereof. The members having the same functions as those in the first embodiment are designated with the same reference symbols to avoid confusion. It should be noted that a toner stirring means 10*a*5 is provided in the cartridge of this embodiment.

Referring to FIG. 22, the process cartridge employed in this embodiment comprises a left side frame portion 14*c* (first frame portion), which is located on the left end in the axial direction of the photosensitive drum 7 (FIG. 22(*a*)), and a right side frame portion 14*d* (second frame portion), which is located on the other end (FIG. 22(*b*)). The frame portion 14*c* is provided with a first projection 24*a* (first projection 24) and a second projection 25*a* (second projection 25), both of which project outward. The frame portion 14*d* is provided with a third projection 24*b* (first projection 24) and a fourth projection 25*b* (second projection 25), both of which also project outward. The first and third projections fix the position of the process cartridge B when the cartridge B is installed into the apparatus A main assembly, and the second and fourth projections serve as the rotational center of the process cartridge when the cartridge B is taken out of (installed into) the apparatus A main assembly. The first and third projection (first projection 24) are disposed in line with the axial line of the photosensitive drum 7. More specifically, they are cylindrical members formed in such a manner as to fit coaxially around the drum shaft of the photosensitive drum 7. Referring to FIG. 22(*a*), a metallic drum shaft 7*c* supporting the photosensitive drum 7 on the left side frame portion 14*c* projects beyond the first cylindrical projection 24*a*, and as the process cartridge B is inserted into the apparatus A mains assembly, this drum shaft 7*c* comes in contact with an electrically conductive member (metallic plate spring 50 illustrated in FIGS. 23(*a*)–23(*c*)) to ground the photosensitive drum 7. Referring to FIG. 22(*b*), the alphanumeric reference 7*d* designates a metallic drum, which supports the photosensitive drum 7 on the right side frame portion 14*d*. Further, the left and right frame portions 14*c* and 14*d* are provided with a fifth projection 14*c*1 and a sixth projection 14*d*1, respectively, which also project outward. The fifth projection 14*c*1 bridges between the peripheral surfaces of the first and second cylindrical projections 24*a* and 25*b*, and the sixth projection 14*d*1 bridges the peripheral surfaces of the third and fourth cylindrical projections 24*b* and 25*b*. These fifth and sixth projections 14*c*1 and 14*d*1 prevent the cartridge B from being over-rotated when the operator takes his/her hand off the knob 26 by mistake immediately after he/she begins to insert the process cartridge B into the apparatus A main assembly, or immediately before he/she finishes removing the cartridge (state illustrated in FIG. 16). Further, when the process cartridge B is oriented, as shown in FIG. 21, the photosensitive drum 7 is positioned toward the bottom, the second cylindrical projection 25*a* is above the first cylindrical projection 24*a*; the fourth cylindrical projection 25*b* is above the third cylindrical projection 24*b*; the second cylindrical projection 25*a* is on the upstream side of the first cylindrical projection 24*a* relative to the direction in which the process cartridge B is inserted into the apparatus A main assembly. In the same manner, the fourth cylindrical projection 25*b* is disposed on the upstream side of the third cylindrical projection 24*b*. The first and third cylindrical projections 24*a* and 24*b* are the same in external diameter, whereas the external diameter of the second cylindrical projection 25*a* is larger than that of the first cylindrical projection 24*a* (also, the third cylindrical projection 24*b*), and the external diameter of the fourth cylindrical projection 25*b* is larger than that of the second cylindrical projection 25*a*. This arrangement of differentiating the sizes of the cylindrical projections can accomplish so-called three point support of the process cartridge B in the apparatus A main assembly (state illustrated in FIG. 14 and FIG. 23(*c*)), which improves the positioning accuracy of the process cartridge in the apparatus A main assembly. As for the actual measurements of these projections in this embodiment, the external diameters of the first and third cylindrical projections 24*a* and 24*b* are approximately 12 mm (tolerable range of 11.0 mm to 12.5 mm); the external diameter of the second cylindrical projection 24*b*, approximately 12.5 mm (tolerable range of 12.0 mm to 13.5 mm); and the fourth cylindrical projection 25*b* is approximately 3.0 mm (tolerable range of 12.0 mm to 13.5 mm). The heights of the first and second cylindrical projections 24*a* and 25*a* are approximately 4.5 mm (tolerable range of 1.0 mm to 5.5 mm), and the heights of the third and fourth cylindrical projection are approximately 4.0 mm (tolerable range of 1.0 mm to 5.0 mm). The height of the fifth projection 14*c*1 is approximately 3.0 mm (tolerable range of 0.0 mm to 5.5 mm), and the height of the sixth projection 14*d*1 is approximately 2.5 mm (tolerable range of 0.0 mm to 5.0 mm). It should be noted here that the provision of the fifth and sixth projections 14*c*1 and 14*d*1 is not mandatory. A distance L between the centers of the first and second cylindrical projections 24*a* and 25*a*, or between those of the third and fourth cylindrical projections 24*b* and 25*b*, is approximately 34 mm. The cleaning means frame 14 constucted integrally with the left side frame portion 14*c* (first frame portion) and right side frame portion 14*d* (second frame portion) contains the photosensitive drum 7, charging means (for example, charging roller 8), and cleaning means (for example, elastic cleaning blade 11*a*), whereas the developing means frame 40 (second cartridge frame) contains the developing means (for example, developing roller 10*c*) and toner storing portion (for example, toner chamber 12*b*). The cleaning means frame 14 and developing means frame 40 are joined pivotally from each other. The alphanumeric reference 14*a*1 designates a groove, with which the engagement projection 16*e* engages.

Referring to FIGS. 23(*a*)–23(*c*), steps for installing the process cartridge B into the main assembly of the apparatus A, or removing it therefrom, will be described.

In the same manner as the aforementioned embodiment, the first projection 24 (24*a* and 24*b*) and second projection 25 (25*a* and 25*b*) are fitted into the guide groove 20*a* and inserted farther into the apparatus along this groove 20*a*. As the cartridge B is inserted to the deepest point, the first projection 24 (24*a* and 24*b*) drops into the positioning recess 20*b*, fixing thereby the position of the cartridge B. At this time, the second projection 25 (25*a* and 25*b*) remains in the guide groove 20*a*, whereby the proper orientation of the cartridge B is maintained. Also, at this time, the position of the process cartridge B of this embodiment is fixed by the so-called three point support. Therefore, the position of the cartridge B in the apparatus A main assembly is more precisely fixed. Further, in this embodiment, the first projection 24 (24*a* and 24*b*), which is disposed in line with the axial line of the photosensitive drum 7, is dropped into the recess 20*b*, and this first projection 24 (24*a* and 24*b*) is retained in the recess 20*b* by direct pressure. More specifically, referring to FIG. 23, a torsional coil spring 20*d* as a pressing means is mounted on a projection 20*c* provided on an installation/removal guide 20. One end of the spring 20*d* is anchored at a stopper 20*i* and the other is anchored at a stopper 20*j*, so that a portion of the torsional coil spring 20*d* projects into the space above the positioning recess 20*b*.

With such an arrangement being in place, as the process cartridge B is inserted along the guide groove 20*a* of the guide member 20 as illustrated in FIG. 23, one end of the torsional coil spring 20*d* comes in contact with the stopper 20*j* as illustrated in FIG. 22(*a*), and as the cartridge B is farther inserted, the first projection 24 (24*a* and 24*b*) is caused to push the torsional coil spring 20*d* as illustrated in FIG. 22(*b*), whereby the one end of the spring 20*d* becomes separated from the stopper 20*j*, generating thereby such a force that presses down the first projection 24 (24*a* and 24*b*). Then, as the cartridge B is farther inserted, the first projection 24 (24*a* and 24*b*) drops into the positioning recess 20*b*, as shown in FIGS. 23(*a*), 23(*b*), and 23(*c*) concluding thereby the installation of the cartridge B. At this time, the first projection 24 (24*a* and 24*b*) is under the downward pressure from the spring 20*d*, being thereby pressed upon the abutting portion 20*b*1 of the positioning recess 20*b*. Therefore, the first projection 24 (24*a* and 24*b*) is securely held in the positioning recess 20*b*.

As described above, the first projection 24 (24*a* and 24*b*) disposed in line with the axial line of the photosensitive drum 7 is directly pressed down by the spring 20*d*; therefore, the positioning of the photosensitive drum 7 in the apparatus A main assembly becomes more accurate.

Next, referring FIG. 24, the moment, which works to drop the first projection 24 (24*a* and 24*b*) into the recess 20*b*, will be described.

As an operator inserts the cartridge into the apparatus A through an opening 20*e* toward the positioning portion 20*b* (diagonally downward), holding the knob and using a force P, the first and second projections 24 (24*a* and 24*b*) and 25 (25*a* and 25*b*) are slid along the cartridge guide 20, wherein the first projection 24 is guided till it comes in contact with the deepest end 20*a*1 of the guide groove 20*a*, above the positioning portion 20*b*. At this point, the cartridge B begins to rotate about the second projection due to a y-component Py of the force P imparted on the first projection 24. As a result, the first projection 24 is engaged into the positioning portion 20*b*, ending the installation of the process cartridge B.

Next, referring to FIG. 25, the moment which works when the cartridge B is taken out, will be described. When the cartridge B is taken out of the apparatus main assembly, the steps illustrated in FIGS. 23(*c*), 23(*b*) and 23(*a*) are followed in this order.

As the operator pulls the knob 26 toward the opening 20*e* of the cartridge guide 20*a* (diagonally upward), using a force P, a rotational moment equivalent to the x-component Px of the force P is generated about the second projection 25 (25*a* and 25*b*), and is imparted on the first projection 24 (24*a* and 24*b*). As a result, the first projection 24 is lifted, whereby the engagement between the positioning portion 20*b* and first projection 24 is broken. In other words, the cartridge B is rotated counterclockwise about the second projection 25.

Then, as the operator pulls the knob 26 further toward him/her, the cartridge B comes out of the apparatus A main assembly with the first and second sliding along the cartridge guide 20*a*.

Further, in this embodiment, a shutter guide portion 20*i* is provided on the upper surface of the guide member 20, extending diagonally upward relative to the process cartridge B inserting direction. This shutter guide portion 20*i* is a portion with which a shutter projection 16*e* provided on the shutter arm 16*d* of the process cartridge B comes in contact. More specifically, as the process cartridge B is inserted along the guide groove 20*a*, the shutter projection 16*e* comes in contact with the guide portion 20*i*, and as the cartridge B is farther inserted, the shutter projection is pushed up. As a result, the shutter member 16 is rotated clockwise against the pressure of a spring (unillustrated) as shown in FIG. 23, whereby the transfer opening 15 and exposure opening 9 are exposed. On the contrary, when the process cartridge B is taken out, the shutter projection 16*e* is pushed down by the pressure from the spring along the slanted surface of the guide portion 20*i*. As a result, the shutter member 16 is rotated counterclockwise, covering thereby the transfer opening 15 and exposure opening 9.

Further, in this embodiment, the first and second cylindrical projection 24*a* and 25*a* and the fifth projection 14*c*1 are integrally formed with the left side frame portion 14*c*, and the third and fourth cylindrical projections, 24*b* and 25*b* along with the sixth projection 14*d*1 are integrally formed with the right side frame portion. In other words, these cylindrical projections 24*a*, 24*b*, 25*a* and 25*b* and the projections 14*c*1 and 14*d*1 are integrally formed with the cleaning means frame 14. This cleaning means frame is composed of plastic material such as highly impact resistant styrene.

{Other Embodiments of Related Components}

The present invention is preferably applicable not only to the above described process cartridge B, which is used to form a monochrome image, but also to a multicolor process cartridge, which is used to form a multicolor image (image of two colors, three colors, or full-color) and comprises two or more developing means.

As for the developing method, the present invention is compatible with various well-known methods such as the double component magnetic brush developing method, cascade developing method, touch down developing method, cloud developing method, and the like.

As for the image bearing member to which the present invention is applicable, it is not limited to the aforementioned photosensitive drum. The present invention is also applicable to the following. To begin with, the photoconductive material is usable as the photosensitive material. As for the photoconductive material, amorphous silicon, amorphous selenium, zinc oxide, titanium oxide, organic photoconductor, or the like, is usable. Further, as for the configuration of a base member on which the photosensitive material is placed, it may be in the form of a rotary member such as a drum, or may be in the form of a sheet such as a belt or the like. Generally speaking, a base member in the form of a drum or a belt is used. For example, in the case of the base member of the drum type, the photoconductive material is coated, deposited, or placed by like means on a cylinder of aluminum alloy or the like.

Further, as to the structure of the charging means, the so-called contact charging method is employed in the first embodiment, but it is needless to say that the present invention is also applicable to other conventional charging methods such as the one in which a metallic shield of aluminum or the like is placed on three sides of a tungsten wire; a high voltage is applied to the tungsten wire to generate positive or negative ions; and the ions are transferred onto the surface of the photosensitive drum to charge it uniformly.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constructed of a blade, fur brush, magnetic brush, or the like.

The process cartridge described above is such a process cartridge that comprises an electro-photographic photosensitive member, or the like, and at least one processing means. In other words, the process cartridge to which the present invention is applicable may be of a different type other than the one employed in the above described embodiments. For example, it may be of such a type that a combination of: an image bearing member and a charging means; an image bearing member and a developing means; an image bearing member and a cleaning means; or an image bearing member and two or more of the aforementioned processing means is integrated into a replaceable form of cartridge for an image forming apparatus.

In other words, the process cartridge described above refers to a cartridge with a charging means, a developing means, or a cleaning means is integrated with an electro-photographic photosensitive member into a replaceable form of cartridge for an image forming apparatus; at least one of a charging means, a developing means, and a cleaning means is integrated with an electro-photographic member into the replaceable cartridge; or at least a developing means and an electro-photographic photosensitive member are integrated into the replaceable cartridge.

In the above described embodiments, a laser beam printer is described as an example of image forming apparatus, but the present invention is not limited to this example. That is, the present invention is also applicable to other image forming apparatuses such as electro-photographic copying machines, facsimile apparatuses, or word processors.

According to the present invention, the process cartridge is structured in such a manner that the movement of the first shutter portion, which exposes or covers the exposure opening, is interlocked with the movement of the second shutter portion, which exposes or covers the transfer opening. Therefore, it is unnecessary to provide separate mechanisms for opening or closing two shutter portions. As a result, the shutter portions can be simplified and made more reliable. Further, the aforementioned integration of the first and second shutter portions eliminates the need for a complicated link mechanism. Therefore, not only can the component count be reduced, but also, the assembly process can be simplified, which leads to a cost reduction.

Further, the rotational center of the shutter member is positioned on top of the cartridge frame. Therefore, the arm portion, which supports the second shutter portion which exposes or covers the transfer opening at each of the longitudinal ends, can be formed so that it does not project beyond the longitudinal end of the cartridge frame. As a result, the cartridge dimension in the longitudinal direction can be reduced, whereby the cartridge size can be reduced.

Further, when the process cartridge is installed into the image forming apparatus main assembly, the second shutter portion is opened in such a manner as to form an air passage. Therefore, the heat generated by the fixing means can be effectively released to prevent an internal temperature increase in the apparatus.

Further, the process cartridge is structured so as to comprise an electro-photographic photosensitive member, developing means, or the like. Therefore, a cartridge capable of recording a highly precise image can be provided.

Therefore, electro-photographic copying machines, laser beam printers, or the like which employ the aforementioned process cartridge according to the present invention can more stably record a higher quality image.

Further, in this embodiment, the toner chamber and developing chamber are constructed by joining: the open frame member constituting the toner chamber frame portion and developing chamber frame portion, which are open on the same side; and the wall member constituting the toner chamber wall portion and developing chamber wall portion, which are joined with the corresponding open sides of the frame member. Therefore, it is possible to form the toner chamber and developing chamber of a complicated configuration by joining just two components. As a result, a developing apparatus or a process cartridge having a large toner capacity in spite of a smaller size can be constructed.

Further, the wall member is disposed at the edge of the toner supply opening, which is located between the toner chamber and developing chamber. Therefore, the toner is prevented from being unnecessarily left in the toner chamber, being thereby used without waste.

Further, the seal retaining portion, which retains the seal member for sealing the toner supply opening, is provided on the wall member; therefore, the sealing member can be easily mounted, and in addition, when a toner depleted developing apparatus or process cartridge is recovered for recycling, the frame member and wall member can be simply recycled.

Further, the wall member constructed of the toner chamber portion and developing chamber portion is bendable at the point between two portions. Therefore, a developing apparatus or process cartridge can be simply assembled.

Further, the end member is attached at each of the longitudinal ends of the frame member and wall member to fix the positional relation between the two members. Therefore, the frame member and wall member can be accurately joined.

Further, the cartridge is structured so as that the toner chamber constituting a part of the developing means is disposed above the developing chamber. Thus, the toner within the toner chamber is supplied to the developing chamber by its own weight, which eliminates the need for the provision of a toner delivering member.

Further, in the embodiments according to the present invention, the first projection is disposed in line with the axial line of the electro-photographic photosensitive member, and the second projection, which serves as the rotational center of the cartridge, is provided. Therefore, these projections serve not only as the guiding members when the process cartridge is inserted into, or removed from, the image forming apparatus, but also, the cartridge can be easily rotated about the second projection when the cartridge is taken out of the apparatus main assembly to disengage the first projection, which has dropped into the positioning recess of the apparatus main assembly. As a result, the cartridge can be smoothly pulled out of the apparatus.

Further, the second projection is positioned behind the first projection relative to the cartridge inserting direction, and the knob is disposed above the line extending from the line connecting the first and second projection. Therefore, the engagement between the first projection and positioning recess can be easily broken just by pulling the knob toward the operator, and then, the cartridge can be easily removed by pulling further the knob toward the operator.

Further, the cartridge installing means provided in the image forming apparatus is constructed so that the cartridge is to be inserted in the diagonally downward direction. Therefore, the cartridge can be smoothly pulled out of the apparatus by holding the knob.

Further, the first and second projection, and the knob, are provided on the frame member which holds the electro-photographic photosensitive member. Thus, the cartridge can be easily rotated about the second projection.

Lastly, the process cartridge comprises: a frame member provided with the projections and a knob; an electro-photographic photosensitive member, a developing means, and the like, which are integrally contained in the frame member. Therefore, the electro-photographic copying machines, laser beam printers, or the like, can stably record a high quality image when constructed to be compatible with this process cartridge.

As described in the foregoing, according to he present invention, there is provided a process cartridge and an image forming apparatus usable therewith, wherein the operation of the mounting and demounting process is improved.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

an electrophotographic photosensitive drum;

process means actable on said photosensitive drum;

a first projection for positioning said process cartridge relative to the main assembly when the process cartridge is mounted to the main assembly, said first projection being outwardly projected substantially coaxially with said photosensitive drum from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected substantially coaxially with said photosensitive drum from a second frame portion adjacent another axial end of said photosensitive drum; and a fourth projection for functioning as a pivot when said process cartridge is demounted from said main assembly, said fourth projection being outwardly projected from the second frame portion;

wherein said second projection is upstream of said first projection, and said fourth projection is upstream of said third projection, in a mounting direction of said process cartridge to said main assembly.

2. A process cartridge according to claim 1, wherein said first projection and third projection comprise circular members on a shaft for supporting said photosensitive drum.

3. A process cartridge according to claim 2, wherein the shaft comprises a metal, and the circular members comprise a plastic resin material.

4. A process cartridge according to claim 3, wherein the circular member as said first projection is integrally formed with said first frame portion, and the circular member as said third projection is integrally formed with said second frame portion.

5. A process cartridge according to claim 2, wherein the shaft is projected from the circular member as said first projection, and is in contact with an electrically conductive member in said main assembly when said process cartridge is mounted to said main assembly.

6. A process cartridge detachably mountable to a main assembly of an image forming apparatus, comprising:

an electrophotographic photosensitive drum;

process means actable on said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum;

a fourth projection for functioning as a pivot when said process cartridge is demounted from said main assembly, said fourth projection being outwardly projected from the second frame portion;

a fifth projection which is elongated and outwardly projected from the first frame portion, said fifth projection connecting said first projection and second projection; and a sixth projection which is elongated and outwardly projected from the second frame portion, said sixth projection connecting said third projection and fourth projection.

7. A process cartridge detachably mountable to a main assembly of an image forming apparatus, comprising:

an electrophotographic photosensitive drum;

a charging member for charging said photosensitive drum;

a developing member for developing a latent image formed on said photosensitive drum;

a cleaning member for removing residual toner from said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum;

a fourth projection for functioning as a pivot when said process cartridge is demounted from said main assembly, said fourth projection being outwardly projected from the second frame portion;

a fifth projection which is elongated and outwardly projected from the first frame portion, said fifth projection connecting said first projection and second projection; and a sixth projection which is elongated and outwardly projected from the second frame portion, said sixth projection connecting said third projection and fourth projection;

wherein said first projection and third projection are on a shaft comprising a metal for supporting said photosensitive drum;

wherein said first projection and second projection are circular members, and said fifth projection connects an outer circular circumference thereof, and said third projection and fourth projection are circular members, and said sixth projection connects an outer circular circumference thereof;

wherein said circular members comprise a plastic resin material; and wherein the circular member as said first projection is integrally formed with said first frame portion, and the circular member as said third projection is integrally formed with said second frame portion.

8. A process cartridge according to claim 7, wherein said first projection, second projection and fifth projection are integrally formed with said first frame portion, and said third projection, fourth projection and sixth projection are integrally formed with said second frame portion.

9. A process cartridge according to claim 1, 6, 7 or 8, wherein when said photosensitive drum takes a low position when said process cartridge is mounted to said main assembly, said second projection is substantially above said first projection, and said fourth projection is substantially above said third projection.

10. A process cartridge according to claim 1, 6 or 8, wherein said first frame portion and second frame portion comprise a plastic resin material, and are integrally formed.

11. A process cartridge according to claim 10, wherein said process means includes charging means, cleaning means, and developing means, wherein a first cartridge frame contains said photosensitive drum, said charging means for charging said photosensitive drum, and said cleaning means for removing residual toner from said photosensitive drum, wherein a second cartridge frame contains said developing means for developing a latent image formed on said photosensitive drum and a toner containing portion for containing toner to be used by said developing means, and wherein said first cartridge frame and said second cartridge frame are swingable relative to each other.

12. A process cartridge according to claim 1 or 6, wherein said first projection and third projection have circular configurations having substantially the same diameters, and said second projection has a circular configuration having a larger outer diameter than that of said first projection and third projection, wherein said fourth projection has a circular configuration having a larger outer diameter than that of the second projection.

13. A process cartridge according to claim 12, wherein outer diameters of the circular members as said first projection and said third projection are approximately 12 mm, and the circular member as said second projection is approximately 12.5 mm, and the circular member as said fourth projection is approximately 13.0 mm.

14. A process cartridge according to claim 7 or 8, wherein the circular members as said first projection and third projection have substantially the same diameters, wherein the circular member as said second projection has a larger outer diameter than that of said first projection and third projection, and wherein the circular member as said fourth projection has a larger outer diameter than that of the second projection.

15. A process cartridge according to claim 14, wherein an outer diameters of the circular members as said first projection and said third projection are approx. 12 mm, and the circular member as said second projection is approx. 12.5, and the circular member as said fourth projection is approx. 13.0 mm.

16. A process cartridge detachably mountable to a main assembly of an image forming apparatus, comprising:

an electrophotographic photosensitive drum;

process means actable on said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum;

a fourth projection for functioning as a pivot when said process cartridge is demounted from said main assembly, said fourth projection being outwardly projected from the second frame portion; and a grip at a position above a line connecting a center of said first projection and a center of said second projection, said grip being usable for mounting and demounting said process cartridge relative to said main assembly;

wherein said second projection is upstream of said first projection, and said fourth projection is upstream of said third projection, in a mounting direction of said process cartridge to said main assembly.

17. A process cartridge according to claim 16, wherein said second projection is upstream of said first projection, and said fourth projection is upstream of said third projection, in a mounting direction of said process cartridge to said main assembly.

18. A process cartridge detachably mountable to a main assembly of an image forming apparatus, comprising:

an electrophotographic photosensitive drum;

process means actable on said photosensitive drum;

a circular first projection for positioning said process cartridge relative to the main assembly when the process cartridge is mounted to the main assembly, said first projection being outwardly projected from a first frame portion adjacent an axial end of said photosensitive drum, said first projection being substantially coaxial with the axis of said photosensitive drum;

a circular second projection for functioning as a pivot when said process cartridge is demounted from said main assembly, said second projection being outwardly projected from the first frame portion, and said second projection being substantially above said first projection when said process cartridge is mounted to said main assembly;

a circular third projection for positioning said process cartridge relative to said main assembly when said process cartridge is mounted to said main assembly, said third projection being outwardly projected from a second frame portion adjacent another axial end of said photosensitive drum, and said third projection being substantially coaxial with the axis of said photosensitive drum; and a circular fourth projection for functioning as a pivot when said process cartridge is demounted from said main assembly, said fourth projection being outwardly projected from the second frame portion, and said fourth projection being substantially above said third projection when said process cartridge is mounted to said main assembly.

19. A process cartridge according to claim 18, wherein said first projection and third projection comprise circular members on a shaft for supporting said photosensitive drum.

20. A process cartridge according to claim 19, wherein the shaft comprises a metal, and the circular members comprise a plastic resin material.

21. A process cartridge according to claim 20, wherein the circular member as said first projection is integrally formed with said first frame portion, and the circular member as said third projection is integrally formed with said second frame portion.

22. A process cartridge according to claim 18, further comprising a fifth projection which is elongated and outwardly projected from the first frame portion, said fifth projection connecting said first projection and second projection, and said process cartridge further comprising a sixth projection which is elongated and outwardly projected from the second frame portion, said sixth projection connecting said third projection and fourth projection.

23. A process cartridge according to claim 22, wherein said fifth projection connects an outer circular circumference of said first projection and second projection, and wherein said sixth projection connects an outer circular circumference of said third projection and fourth projection.

24. A process cartridge according to claim 22, wherein said first projection, second projection and fifth projection are integrally formed with said first frame portion, and said third projection, fourth projection and sixth projection are integrally formed with said second frame portion.

25. A process cartridge according to claim 21 or 24, wherein when said photosensitive drum takes a low position when said process cartridge is mounted to said main assembly, said second projection is substantially above said first projection, and said fourth projection is substantially above said third projection.

26. A process cartridge according to claim 18, wherein said second projection is upstream of said first projection, and said fourth projection is upstream of said third projection, in a mounting direction of said process cartridge to said main assembly.

27. A process cartridge according to claim 18 or 26, further comprising a grip at a position above a line connecting a center of said first projection and a center of said second projection, said grip being usable for mounting and demounting said process cartridge relative to said main assembly.

28. A process cartridge according to claim 18, wherein said first frame portion and second frame portion comprise a plastic resin material, and are integrally formed.

29. A process cartridge according to claim 28, wherein said process means includes at least one of charging means, cleaning means, and developing means, and wherein a first cartridge frame contains said photosensitive drum, said charging means for charging said photosensitive drum, and said, cleaning means for removing residual toner from said photosensitive drum, wherein a second cartridge frame contains said developing means for developing a latent image formed on said photosensitive drum and a toner containing portion for containing toner to be used by said developing means, and wherein said first cartridge frame and said second cartridge frame are swingable relative to each other.

30. A process cartridge according to claim 18, wherein said image forming apparatus is provided with a pair of guiding grooves for guiding said process cartridge, and a pair of recesses for positioning said process cartridge, wherein when said process cartridge is mounted to or demounted from said main assembly, said first projection and second projection are guided by one of said guiding grooves, and said third projection and fourth projection are guided by the other guiding groove, and wherein said first projection is engaged with said one of recesses, and said third projection is engaged with the other recess to position said process cartridge in place in said main assembly, and wherein when said process cartridge is rotated with said second projection and fourth projection functioning as a pivot, said first projection is disengaged from said one of the recesses, and said third projection is disengaged from said other recess.

31. A process cartridge according to claim 1 or 18, wherein said process means contains charging means for charging said photosensitive drum, developing means for developing a latent image formed on said photosensitive drum, or cleaning means for removing residual toner from said photosensitive drum.

32. A process cartridge according to claim 1 or 18, wherein said process means contains at least one of charging means for charging said photosensitive drum, developing means for developing a latent image formed on said photosensitive drum, and cleaning means for removing residual toner from said photosensitive drum.

33. A process cartridge according to claim 1 or 18, wherein said process means contains at least developing means for developing a latent image formed on said photosensitive drum.

34. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a first cartridge frame having said photosensitive drum, said charging roller and said cleaning blade;

a second cartridge frame having said developing roller, said second cartridge frame being swingable relative to said first cartridge frame;

a circular first projection for positioning said process cartridge relative to the main assembly when the process cartridge is mounted to the main assembly, said first projection being outwardly projected from a first frame portion of said first cartridge frame adjacent an axial end of said photosensitive drum, and said first projection being substantially coaxial with an axis of said photosensitive drum;

a circular second projection for functioning as a pivot when said process cartridge is demounted from said main assembly, said second projection being outwardly projected from the first frame portion, and said second projection being above said first projection when said process cartridge is mounted to said main assembly;

a circular third projection for positioning said process cartridge relative to said main assembly when said process cartridge is mounted to said main assembly, said third projection being outwardly projected from a second frame portion of said first cartridge frame adjacent another axial end of said photosensitive drum, and said third projection being substantially coaxial with the axis of said photosensitive drum;

a circular fourth projection for functioning as a pivot when said process cartridge is demounted from said main assembly, said fourth projection being outwardly projected from the second frame portion, and said fourth projection being above said third projection when said process cartridge is mounted to said main assembly;

an elongated fifth projection for connecting said first projection and said second projection;

an elongated sixth projection for connecting said third projection and said fourth projection; and a grip on a top surface of said first cartridge frame, said grip being usable when said process cartridge is mounted and demounted relative to said main assembly.

35. A process cartridge according to claim 34, wherein said first projection and third projection are substantially coaxial with a shaft for supporting said photosensitive drum.

36. A process cartridge according to claim 35, wherein the shaft comprises a metal, and the circular projections comprise a plastic resin material.

37. A process cartridge according to claim 34 or 36, wherein said second projection is upstream of said first projection, and said fourth projection is upstream of said third projection, in a mounting direction of said process cartridge to said main assembly.

38. A process cartridge according to claim 34, wherein said second projection, third projection, fourth projection, fifth projection, sixth projection and grip are integrally formed with said first cartridge frame.

39. A process cartridge according to claim 34, 36 or 38, wherein the circular first projection and circular third projection have substantially the same diameters, wherein the circular second projection has a larger outer diameter than that of said circular first projection and circular third projection, and wherein the circular fourth projection has a larger outer diameter than that of the circular second projection.

40. A process cartridge according to claim 39, wherein outer diameters of the circular first projection and said circular third projection are approximately 12 mm, and the circular second projection is approximately 12.5 mm, and the circular fourth projection is approximately 13.0 mm.

41. A process cartridge detachably mountable to a main assembly of an image forming apparatus, comprising:

an electrophotographic photosensitive drum;

process means actable on said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum; and a fourth projection for functioning as a pivot when said process cartridge is demounted from said main assembly, said fourth projection being outwardly projected from the second frame portion;

wherein when said photosensitive drum takes a low position when said process cartridge is mounted to said main assembly, said second projection is above said first projection, and said fourth projection is above said third projection;

wherein said second projection is upstream of said first projection, and said fourth projection is upstream of said third projection, in a mounting direction of said process cartridge to said main assembly.

42. A process cartridge detachably mountable to a main assembly of an image forming apparatus, comprising:

an electrophotographic photosensitive drum;

a charging member for charging said photosensitive drum;

a developing member for developing a latent image formed on said photosensitive drum;

a cleaning member for removing residual toner from said photosensitive drum;

a circular first projection for positioning said process cartridge relative to the main assembly when the process cartridge is mounted to the main assembly, said first projection being outwardly projected from a first frame portion adjacent an axial end of said photosensitive drum;

a circular second projection for functioning as a pivot when said process cartridge is demounted from said main assembly, said second projection being outwardly projected from the first frame portion;

a circular third projection for positioning said process cartridge relative to said main assembly when said process cartridge is mounted to said main assembly, said third projection being outwardly projected from a second frame portion adjacent another axial end of said photosensitive drum; and a circular fourth projection for functioning as a pivot when said process cartridge is demounted from said main assembly, said fourth projection being outwardly projected from the second frame portion;

wherein the circular first projection and circular third projection have substantially the same diameters, and the circular second projection has a larger outer diameter than that of said circular first projection and circular third projection, and wherein the circular fourth projection has a larger outer diameter than that of the circular second projection; and wherein outer diameters of the circular first projection and said circular third projection are approximately 12 mm, and the circular second projection is approximately 12.5 mm, and the circular fourth projection is approximately 13.0 mm.

43. A process cartridge detachably mountable to a main assembly of an image forming apparatus, comprising:

a cartridge frame;

an electrophotographic photosensitive drum;

process means actable on said photosensitive drum;

a first projection for positioning said process cartridge relative to the main assembly when the process cartridge is mounted to the main assembly, said first projection being outwardly projected substantially coaxially with said photosensitive drum from said cartridge frame adjacent an axial end of said photosensitive drum;

a second projection for functioning as a pivot when said process cartridge is demounted from said main assembly, said second projection being outwardly projected from said cartridge frame; and a third projection for positioning said process cartridge relative to said main assembly when said process cartridge is mounted to said main assembly, said third projection being outwardly projected substantially coaxially with said photosensitive drum from said cartridge frame adjacent another axial end of said photosensitive drum;

wherein said second projection is upstream of said first projection, in a mounting direction of said process cartridge to said main assembly.

44. A process cartridge according to claim 43, further comprising a fourth projection for functioning as a pivot when said process cartridge is demounted from said main assembly, said fourth projection being outwardly projected from said cartridge frame.

45. A process cartridge according to claim 43, wherein said process means contains at least one of charging means for charging said photosensitive drum, developing means for developing a latent image formed on said photosensitive drum, and cleaning means for removing residual toner from said photosensitive drum.

46. A process cartridge according to claim 1, 16, or 41, wherein when said process cartridge is mounted to the main assembly, said first projection enters the main assembly earlier than said second projection, and said third projection enters the main assembly earlier than said fourth projection.

47. A process cartridge according to claim 6, 7, or 42, wherein said second projection is upstream of said first projection, and said fourth projection is upstream of said third projection, in a mounting direction of said process cartridge to said main assembly.

48. A process cartridge according to claim 18 or 34, wherein said image forming apparatus is provided with a pair of guiding grooves for guiding said process cartridge, and a pair of recesses for positioning said process cartridge, wherein when said process cartridge is mounted to or demounted from said main assembly, said circular first projection and circular second projection are guided by one of said guiding grooves, and said circular third projection and circular fourth projection are guided by the other guiding groove, and wherein said first projection is engaged with said one of recesses, and said third projection is engaged with the other recess to position said process cartridge in place in said main assembly, and wherein when said process cartridge is rotated with said second projection and fourth projection functioning as a pivot, said first projection is disengaged from said one of the recesses, and said third projection is disengaged from said other recess.

49. A process cartridge according to claim 6, 16, 41, or 42, wherein said process means contains at least one of charging means for charging said photosensitive drum, developing means for developing a latent image formed on said photosensitive drum, and cleaning means for removing residual toner from said photosensitive drum.

50. A process cartridge according to claim 16, 18, 34, 41, or 42, wherein when said photosensitive drum takes a low position when said process cartridge is mounted to said main assembly, said second projection is substantially above said first projection, and said fourth projection is substantially above said third projection.

51. A process cartridge according to claim 1, 6, 7, 16, 18, 41, 42, or 43, further comprising a grip at a position above a line connecting a center of said first projection and a center of said second projection, said grip being usable for mounting and demounting said process cartridge relative to said main assembly.

52. A process cartridge according to claim 51, wherein said grip is on a top surface of a cartridge frame.

53. A process cartridge detachably mountable to a main assembly of an image forming apparatus, comprising:

an electrophotographic photosensitive drum;

process means actable on said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum; and a fourth projection for functioning as a pivot when said process cartridge is demounted from said main assembly, said fourth projection being outwardly projected from the second frame portion;

wherein said first projection and third projection comprise circular members on a shaft that supports said photosensitive drum;

wherein the shaft comprises a metal, and the circular members comprise a plastic resin material;

wherein the circular member as said first projection is integrally formed with said first frame portion, and the circular member as said third projection is integrally formed with said second frame portion; and wherein when said photosensitive drum takes a low position when said process cartridge is mounted to said main assembly, said second projection is above said first projection, and said fourth projection is above said third projection.

54. A process cartridge detachably mountable to a main assembly of an image forming apparatus, comprising:

a cartridge frame;

an electrophotographic photosensitive drum;

a charging member for charging said photosensitive drum;

a developing member for developing a latent image formed on said photosensitive drum;

a cleaning member for removing residual toner from said photosensitive drum;

a first projection for positioning said process cartridge relative to the main assembly when the process cartridge is mounted to the main assembly, said first projection being outwardly projected substantially coaxially with said photosensitive drum from said cartridge frame adjacent an axial end of said photosensitive drum;

a second projection for functioning as a pivot when said process cartridge is demounted from said main assembly, said second projection being outwardly projected from said cartridge frame;

a third projection for positioning said process cartridge relative to said main assembly when said process cartridge is mounted to said main assembly, said third projection being outwardly projected substantially coaxially with said photosensitive drum from said cartridge frame adjacent another axial end of said photosensitive drum; and a grip at a position above a line connecting a center of said first projection and a center of said second projection, said grip being usable for mounting and demounting said process cartridge relative to said main assembly;

wherein said second projection is upstream of said first projection, in a mounting direction of said process cartridge to said main assembly;

wherein when said photosensitive drum takes a low position when said process cartridge is mounted to said main assembly, said second projection is substantially above said first projection.

55. A process cartridge according to claim 54, wherein said first projection and third projection are circular members on a shaft for supporting said photosensitive drum.

56. A process cartridge according to claim 55, wherein the shaft comprises a metal, and the circular members comprise a plastic resin material.

57. A process cartridge according to claim 56, wherein the circular member as said first projection is integrally formed with said cartridge frame, and the circular member as said third projection is integrally formed with said cartridge frame.

58. A process cartridge according to claim 54, wherein said grip is on a top surface of the cartridge frame.

59. A process cartridge according to claim 54, further comprising a fourth projection for functioning as a pivot when said process cartridge is demounted from said main assembly, said fourth projection being outwardly projected from said cartridge frame.

60. An image forming apparatus for forming an image on a recording material, comprising:

(a) mounting means for detachably mounting a process cartridge to a main assembly of the image forming apparatus, said process cartridge including:

a cartridge frame;

an electrophotographic photosensitive drum;

a charging member for charging said photosensitive drum;

a developing member for developing a latent image formed on said photosensitive drum;

a cleaning member for removing residual toner from said photosensitive drum;

a first projection for positioning said process cartridge relative to the main assembly when the process cartridge is mounted to the main assembly, said first projection being outwardly projected substantially coaxially with said photosensitive drum from said cartridge frame adjacent an axial end of said photosensitive drum;

a second projection for functioning as a pivot when said process cartridge is demounted from said main assembly, said second projection being outwardly projected from said cartridge frame; and a third projection for positioning said process cartridge relative to said main assembly when said process cartridge is mounted to said main assembly, said third projection being outwardly projected substantially coaxially with said photosensitive drum from said cartridge frame adjacent another axial end of said photosensitive drum;

wherein said second projection is upstream of said first projection, in a mounting direction of said process cartridge to said main assembly;

(b) a first positioning member for positioning said first projection;

(c) a second positioning member for positioning said third projection;

(d) a first guiding member for guiding said first projection and second projection;

(e) a second guiding member for guiding said third projection; and (f) a feeding member for feeding the recording material.

61. An image forming apparatus for forming an image on a recording material, comprising:

(a) mounting means for detachably mounting a process cartridge to a main assembly of the image forming apparatus, said process cartridge including:

a cartridge frame;

an electrophotographic photosensitive drum;

a charging member for charging said photosensitive drum;

a developing member for developing a latent image formed on said photosensitive drum;

a cleaning member for removing residual toner from said photosensitive drum;

a first projection for positioning said process cartridge relative to the main assembly when the process cartridge is mounted to the main assembly, said first projection being outwardly projected substantially coaxially with said photosensitive drum from said cartridge frame adjacent an axial end of said photosensitive drum;

a second projection for functioning as a pivot when said process cartridge is demounted from said main assembly, said second projection being outwardly projected from said cartridge frame;

a third projection for positioning said process cartridge relative to said main assembly when said process cartridge is mounted to said main assembly, said third projection being outwardly projected substantially coaxially with said photosensitive drum from said cartridge frame portion adjacent another axial end of said photosensitive drum; and a grip at a position above a line connecting a center of said first projection and a center of said second projection, said grip being usable for mounting and demounting said process cartridge relative to said main assembly;

wherein said second projection is upstream of said first projection, in a mounting direction of said process cartridge to said main assembly;

wherein when said photosensitive drum takes a low position when said process cartridge is mounted to said main assembly, said second projection is substantially above said first projection;

(b) a first positioning member for positioning said first projection;

(c) a second positioning mounting member for positioning said third projection;

(d) a first guiding member for guiding said first projection and second projection;

(e) a second guiding member for guiding said third projection; and (f) a feeding member for feeding the recording material.

62. An apparatus according to claim 60 or 61, wherein said first guiding member is in the form of a groove which, when said process cartridge is mounted to the main assembly, limits upward movement of said second projection by its upper surface, and supports said second projection by its lower surface.

63. A process cartridge detachably mountable to a main assembly of an image forming apparatus provided with a pair of guiding grooves for guiding said process cartridge and a pair of recesses for positioning said process cartridge, comprising:

an electrophotographic photosensitive drum;

a charging roller for charging said photosensitive drum;

a developing roller for developing a latent image formed on said photosensitive drum;

cleaning means for removing residual toner from said photosensitive drum;

a first cartridge frame having said photosensitive drum, said charging roller and said cleaning means;

a second cartridge frame having said developing roller, said second cartridge frame being swingable relative to said first cartridge frame;

a circular first projection for positioning said process cartridge relative to the main assembly by engagement with said one of the recesses when the process cartridge is mounted to the main assembly, said first projection being outwardly projected from a first frame portion of said first cartridge frame adjacent an axial end of said photosensitive drum, said first projection being coaxial with said photosensitive drum, wherein when said process cartridge is mounted to or demounted from the main assembly, said first projection is guided by one of the guiding grooves;

a circular second projection for functioning as a pivot when said process cartridge is demounted from said main assembly, said second projection being outwardly projected from said first frame portion, and said second projection being above said first projection when said process cartridge is mounted to said main assembly, wherein when said process cartridge is mounted to or demounted from said main assembly, said second projection is guided by said one of the guiding grooves;

a circular third projection for positioning said process cartridge relative to said main assembly by engagement with the other recess of said main assembly when said process cartridge is mounted to said main assembly, said third projection being outwardly projected from a second frame portion adjacent another axial end of said photosensitive drum, and said third projection being coaxial with said photosensitive drum, wherein when said process cartridge is mounted to or demounted from said main assembly, said third projection is guided by the other guiding groove;

a circular fourth projection for functioning as a pivot when said process cartridge is demounted from said main assembly, said fourth projection being outwardly projected from the second frame portion, and said fourth projection being above said third projection when said process cartridge is mounted to said main assembly, wherein when said process cartridge is mounted to or demounted from said main assembly, said fourth projection is guided by said other guiding groove;

an elongated fifth projection for connecting said first projection and said second projection;

an elongated sixth projection for connecting said third projection and said fourth projection; and a grip on a top surface of said first cartridge frame, said grip being usable when said process cartridge is mounted and demounted relative to said main assembly;

wherein said second projection is upstream of said first projection, and said fourth projection is upstream of said third projection, in a mounting direction of said process cartridge to said main assembly;

wherein said first projection, second projection, third projection, fourth projection, fifth projection, sixth projection and grip are integrally formed with said first cartridge frame; and wherein said circular first projection and third projection have substantially the same diameters, and said circular second projection has a larger outer diameter than that of said first projection and third projection, wherein said circular fourth projection has a larger outer diameter than that of the second projection.

64. A process cartridge according to claim 63, wherein said first projection and third projection are circular members on a shaft that supports said photosensitive drum.

65. A process cartridge according to claim 63, wherein the shaft is of metal, and the circular members are of plastic resin material.

66. A process cartridge according to claim 63, 64 or 65, wherein outer diameters of said circular first projection and said circular third projection are approximately 12 mm, said circular second projection is approximately 12.5 mm, and said circular fourth projection is approximately 13.0 mm.

67. An image forming apparatus for forming an image on a recording material, comprising:

(a) mounting means for detachably mounting a process cartridge detachably mountable to a main assembly of the image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a first cartridge frame having said photosensitive drum, said charging roller and said cleaning blade;

a second cartridge frame having said developing roller, said second cartridge frame being swingable relative to said first cartridge frame;

a circular first projection for positioning said process cartridge relative to the main assembly when the process cartridge is mounted to the main assembly, said first projection being outwardly projected from a first frame portion of said first cartridge frame adjacent an axial end of said photosensitive drum, said first projection being coaxial with said photosensitive drum;

a circular second projection for functioning as a pivot when said process cartridge is demounted from said main assembly, said second projection being outwardly projected from the first frame portion, and said second projection of said first cartridge frame being above said first projection when said process cartridge is mounted to said main assembly;

a circular third projection for positioning said process cartridge relative to said main assembly when said process cartridge is mounted to said main assembly, said third projection being outwardly projected from a second frame portion adjacent another axial end of said photosensitive drum, and said third projection being coaxial with said photosensitive drum;

a circular fourth projection for functioning as a pivot when said process cartridge is demounted from said main assembly, said fourth projection being outwardly projected from the second frame portion, and said fourth projection being above said third projection when said process cartridge is mounted to said main assembly;

an elongated fifth projection for connecting said first projection and said second projection;

an elongated sixth projection for connecting said third projection and said fourth projection; and a grip on a top surface of said first cartridge frame, said grip being usable when said process cartridge is mounted and demounted relative to said main assembly;

(b) a first guiding groove for guiding said circular first projection and said circular second projection when said process cartridge is mounted to or demounted from said main assembly;

(c) a second guiding groove for guiding said circular third projection and said circular fourth projection when said process cartridge is mounted to or demounted from said main assembly;

(d) a first recess for engagement with said circular first projection;

(e) a second recess for engagement with said circular third projection; and (f) feeding rollers for feeding the recording material;

wherein when said process cartridge is rotated with said second projection and fourth projection functioning as a pivot, said first projection is disengaged from said first recess, and said third projection is disengaged from said second recess.

68. A process cartridge detachably mountable to a main assembly of an electrophotographic image forming apparatus, comprising:

(a) an electrophotographic photosensitive drum;

(b) process means actable on said electrophotographic photosensitive drum;

(c) a cartridge frame;

(d) a first projection for positioning said process cartridge at a predetermined position in the main assembly of the apparatus when said process cartridge is mounted to the main assembly of the apparatus, said first projection being projected coaxially with said electrophotographic photosensitive drum and outwardly from an end, in a direction of an axis of said electrophotographic photosensitive drum, of said cartridge frame;

(e) a second projection for providing a pivot when said process cartridge is rotated in a direction for releasing the positioning of said first projection to dismount said process cartridge from the main assembly of the apparatus, said second projection being projected outwardly from the end, in a direction of the axis of said electrophotographic photosensitive drum, of said cartridge frame, at a position above said first projection when said process cartridge is mounted to the main assembly of the apparatus and downstream of said first projection with respect to a direction for dismounting said process cartridge from the main assembly of the apparatus.

69. A process cartridge according to claim 68, wherein said cartridge frame includes a first frame and a second frame which is disposed upstream of said first frame with respect to a direction for mounting said process cartridge to the main assembly of the apparatus and which is swingably connected with said first frame;

wherein said first frame has developing means, as said process means, for developing a latent image formed on said electrophotographic photosensitive drum and a toner accommodating portion for accommodating toner to be used by said developing means for development, and said second frame has said first projection, said second projection, said electrophotographic photosensitive drum, charging means, as said process means, for charging said electrophotographic photosensitive drum, and cleaning means, as said process means, for removing toner remaining on said electrophotographic photosensitive drum.

70. A process cartridge according to claim 69, wherein said second frame is provided with a grip for being gripped when said process cartridge is mounted to or demounted from the main assembly of the apparatus, said grip being provided above a line connecting a center of said first projection and a center of said second projection as seen from one axial end of said cartridge frame when said process cartridge is mounted to the main assembly of the apparatus.

71. A process cartridge according to claim 70, wherein when force is applied to said grip in a direction for demounting said process cartridge from the main assembly of the apparatus, said process cartridge is rotated about said second projection, functioning as a pivot, so that positioning by said first projection is released.

72. A process cartridge according to claim 71, wherein an end, in the axial direction, of said second frame is provided with a third projection projected outwardly of said cartridge frame and connecting said first projection and said second projection.

73. A process cartridge according to claim 72, wherein when said process cartridge is mounted to the main assembly of the apparatus, said second projection is supported by a guide groove provided in the main assembly to retain an orientation of said process cartridge.

74. A process cartridge according to claim 73, wherein said first projection and said second projection are circular, and an outer diameter of said second projection is larger than an outer diameter of said first projection.

75. A process cartridge according to claim 69, 70, 71, 72, 73 or 74 wherein said second frame, said first projection and said second projection are of plastic resin material and are integrally molded.

76. A process cartridge according to claim 68, wherein said cartridge frame is provided with a grip for being gripped when said process cartridge is mounted to or demounted from the main assembly of the apparatus, said grip being provided above a line connecting a center of said first projection and a center of said second projection as seen from one axial end of said cartridge frame when said process cartridge is mounted to the main assembly of the apparatus.

77. A process cartridge according to claim 68, wherein said process cartridge contains as a unit said electrophotographic photosensitive drum and at least one of developing means, as said process means, for developing a latent image formed on said electrophotographic photosensitive drum, charging means for charging said electrophotographic photosensitive drum, and cleaning means for removing toner remaining on said electrophotographic photosensitive drum, and is detachably mountable as a unit relative to the main assembly of the electrophotographic image forming apparatus.

78. A process cartridge according to claim 68 or 77, wherein the main assembly of the apparatus has a guide groove extending in an inclined downward direction and a positioning recess continuous from said guide groove, and wherein when said process cartridge is mounted to the main assembly of the apparatus along said guide groove, said first projection is in engagement with the positioning recess to position said process cartridge at a predetermined position in the main assembly, and said second projection, when said process cartridge is demounted from the main assembly, functions as a pivot while contacting a part of the guide groove to permit rotation of said process cartridge in a direction for releasing engagement between said first projection and the positioning recess.

79. An image forming apparatus for forming an image on a recording material, to which a process cartridge is detachably mountable, wherein said process cartridge includes an electrophotographic photosensitive drum; process means actable on said electrophotographic photosensitive drum; a cartridge frame; a first projection for positioning said process cartridge at a predetermined position in the main assembly of the apparatus when said process cartridge is mounted to the main assembly of the apparatus, said first projection being projected coaxially with said electrophotographic photosensitive drum and outwardly from an end, in a direction of an axis of said electrophotographic photosensitive drum, of said cartridge frame; a second projection for providing a pivot when said process cartridge is rotated in a direction for releasing the positioning of said first projection to dismount said process cartridge from the main assembly of the apparatus, said second projection being projected outwardly from the end, in a direction of the axis of said electrophotographic photosensitive drum, of said cartridge frame, at a position above said first projection when said process cartridge is mounted to the main assembly of the apparatus and downstream of said first projection with respect to a direction for dismounting said process cartridge from the main assembly of the apparatus;

said apparatus comprising:

(a) a guide groove, which is extended in an inclined downward direction, for guiding the first projection and the second projection of said process cartridge when said process cartridge is detachably mounted to said apparatus; and (b) a positioning recess, continuous with said guide groove, for engagement with said first projection to position said process cartridge at a predetermined position of the main assembly of the apparatus when said process cartridge is mounted to the main assembly along said guide groove.

80. An image forming apparatus for forming an image on a recording material, comprising:

(a) mounting means for detachably mounting a process cartridge to a main assembly of an image forming apparatus, said process cartridge including:

an electrophotographic photosensitive drum;

process means actable on said photosensitive drum;

a first projection for positioning said process cartridge relative to the main assembly when the process cartridge is mounted to the main assembly, said first projection being outwardly projected substantially coaxially with said photosensitive drum from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected substantially coaxially with said photosensitive drum from a second frame portion adjacent another axial end of said photosensitive drum; and a fourth projection for functioning as a pivot when said process cartridge is demounted from said main assembly, said fourth projection being outwardly projected from the second frame portion;

wherein said second projection is upstream of said first projection, and said fourth projection is upstream of said third projection, in a mounting direction of said process cartridge to said main assembly;

(b) a first positioning member for positioning said first projection;

(c) a second positioning member for positioning said third projection;

(d) a first guiding member for guiding said first projection and said second projection;

(e) a second guiding member for guiding said third projection and said fourth projection; and (f) a feeding member for feeding the recording material.

81. An image forming apparatus for forming an image on a recording material, comprising:

(a) mounting means for detachably mounting a process cartridge to a main assembly of an image forming apparatus, said process cartridge including:

an electrophotographic photosensitive drum;

process means actable on said photosensitive drum;

a circular first projection for positioning said process cartridge relative to the main assembly when the process cartridge is mounted to the main assembly, said first projection being outwardly projected from a first frame portion adjacent an axial end of said photosensitive drum, said first projection being substantially coaxial with an axis of said photosensitive drum;

a circular second projection for functioning as a pivot when said process cartridge is demounted from said main assembly, said second projection being outwardly projected from the first frame portion, and said second projection being substantially above said first projection when said process cartridge is mounted to said main assembly;

a circular third projection for positioning said process cartridge relative to said main assembly when said process cartridge is mounted to said main assembly, said third projection being outwardly projected from a second frame portion adjacent another axial end of said photosensitive drum, and said third projection being substantially coaxial with the axis of said photosensitive drum; and a circular fourth projection for functioning as a pivot when said process cartridge is demounted from said main assembly, said fourth projection being outwardly projected from the second frame portion, and said fourth projection being substantially above said third projection when said process cartridge is mounted to said main assembly;

(b) a first positioning member for positioning said first projection;

(c) a second positioning member for positioning said third projection;

(d) a first guiding member for guiding said first projection and said second projection;

(e) a second guiding member for guiding said third projection and said fourth projection; and (f) a feeding member for feeding the recording material.

82. An image forming apparatus for forming an image on a recording material, comprising:

(a) mounting means for mounting a process cartridge detachably mountable to a main assembly of an image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a first cartridge frame having said photosensitive drum, said charging roller and said cleaning blade;

a second cartridge frame having said developing roller, said second cartridge frame being swingable relative to said first cartridge frame;

a circular first projection for positioning said process cartridge relative to the main assembly when the process cartridge is mounted to the main assembly, said first projection being outwardly projected from a first frame portion of said first cartridge frame adjacent an axial end of said photosensitive drum, and said first projection being substantially coaxial with an axis of said photosensitive drum;

a circular second projection for functioning as a pivot when said process cartridge is demounted from said main assembly, said second projection being outwardly projected from the first frame portion, and said second projection being above said first projection when said process cartridge is mounted to said main assembly;

a circular third projection for positioning said process cartridge relative to said main assembly when said process cartridge is mounted to said main assembly, said third projection being outwardly projected from a second frame portion of said first cartridge frame adjacent another axial end of said photosensitive drum, and said third projection substantially coaxial with the axis of said photosensitive drum;

a circular fourth projection for functioning as a pivot when said process cartridge is demounted from said main assembly, said fourth projection being outwardly projected from the second frame portion, and said fourth projection being above said third projection when said process cartridge is mounted to said main assembly;

an elongated fifth projection for connecting said first projection and said second projection;

an elongated sixth projection for connecting said third projection and said fourth projection; and a grip on a top surface of said first cartridge frame, said grip being usable when said process cartridge is mounted and demounted relative to said main assembly;

(b) a first positioning member for positioning said first projection;

(c) a second positioning member for positioning said third projection;

(d) a first guiding member for guiding said first projection and said second projection;

(e) a second guiding member for guiding said third projection and said fourth projection; and (f) a feeding member for feeding the recording material.

83. An apparatus according to claim 81 or 82, wherein said mounting means including first guiding means for guiding said first projection and second projection, and second guiding means for guiding said third projection and said fourth projection.

84. An apparatus according to claim 80, 81 or 82, wherein said first positioning member comprises a recess connecting with said first guiding member and a spring for urging said first projection to said recess, and said second positioning member comprises a recess connecting with said second guiding member and a spring for urging said third projection to said recess.

85. An image forming apparatus for forming an image on a recording material, comprising:

(a) mounting means for detachably mounting a process cartridge to a main assembly of an image forming apparatus, said process cartridge including:

an electrophotographic photosensitive drum;

process means actable on said photosensitive drum;

a first projection for positioning said process cartridge relative to the main assembly when the process cartridge is mounted to the main assembly, said first projection being outwardly projected from a first frame portion adjacent an axial end of said photosensitive drum;

a second projection for functioning as a pivot when said process cartridge is demounted from said main assembly, said second projection being outwardly projected from the first frame portion;

a third projection for positioning said process cartridge relative to said main assembly when said process cartridge is mounted to said main assembly, said third projection being outwardly projected from a second frame portion adjacent another axial end of said photosensitive drum; and a fourth projection for functioning as a pivot when said process cartridge is demounted from said main assembly, said fourth projection being outwardly projected from the second frame portion;

(b) a first positioning member for positioning said first projection;

(c) a second positioning member for positioning said third projection; and (d) a feeding member for feeding the recording material;

wherein said mounting means comprises a first guiding member for guiding said first projection and said second projection, and a second guiding member for guiding said third projection and said fourth projection, and wherein said first positioning member comprises a recess connecting with said first guiding member and a spring for urging said first projection to said recess, and said second positioning member comprises a recess connecting with said second guiding member and a spring for urging said third projection to said recess.

86. A process cartridge detachably mountable relative to a main assembly of an electrophotographic image forming apparatus, said process cartridge comprising:

a. an electrophotographic photosensitive drum;

b. process means actable on said electrophotographic photosensitive drum;

c. a cartridge frame;

d. a first projection for positioning said process cartridge at a predetermined position in said main assembly when said process cartridge is mounted to said main assembly, said first projection being projected outwardly from a longitudinal end of said cartridge frame in a direction of an axis of said electrophotographic photosensitive drum;

e. a second projection functioning as a pivot for rotation of said process cartridge in a direction of releasing positioning of said first projection to demount said process cartridge from the main assembly, said second projection being projected outwardly from a longitudinal end of said cartridge frame at a position above said first projection and downstream of said first projection in a direction of demounting said process cartridge from the main assembly when said process cartridge is mounted in the main assembly;

f. a grip provided above a line connecting a center of said first projection and a center of said second projection as seen from an extension of the axis of said photosensitive drum, wherein the positioning of said first projection is released by gripping said grip to apply force in the demounting direction and rotating said process cartridge about said second projection.

87. A process cartridge according to claim 86, wherein said cartridge frame includes a first frame and a second frame pivotably coupled with said first frame and disposed upstream of said first frame with respect to a direction of mounting said process cartridge to the main assembly, wherein said first frame contains developing means as said process means for developing a latent image formed on said photosensitive drum and a toner accommodating portion for accommodating toner to be used by said developing means, and said second frame is provided with said grip, said first projection and said second projection, and contains said photosensitive drum, charging means as said process means for electrically charging said photosensitive drum and cleaning means as said process means for removing residual toner remaining on said photosensitive drum.

88. A process cartridge according to claim 86, further comprising a third projection projected outwardly from a longitudinal end of said process cartridge, said third projection connects said first projection with said second projection.

89. A process cartridge according to claim 86, wherein said second projection is supported by a guiding groove formed in the main assembly to maintain an orientation of said process cartridge when said process cartridge is mounted to the main assembly.

90. A process cartridge according to claim 86, wherein said first and second projection have circular outer peripheries, and said second projection has a larger diameter than said first projection.

91. A process cartridge according to claim 86, wherein said process cartridge is demounted from the main assembly in an inclined direction.

92. A process cartridge according to claim 87, wherein said second frame, said first projection and said second projection are integrally formed of plastic resin material.

93. A process cartridge according to claim 86, wherein said process cartridge contains as a unit said photosensitive drum, and as said process means at least one of developing means for developing a latent image formed on said photosensitive drum, charging means for electrically charging said photosensitive drum, and cleaning means for removing residual toner from said photosensitive drum, and said process cartridge is detachably mountable as a unit relative to the main assembly.

94. A process cartridge according to claim 86, wherein said process cartridge is detachably mountable to the main assembly provided with a guiding groove extended in an inclined downward direction and a positioning recess continuing to said guiding groove, and when said process cartridge is mounted to the main assembly along said guiding groove, said first projection is engaged with said positioning recess to position said process cartridge at the predetermined position, and wherein when said process cartridge is demounted from the main assembly, said second projection is conducted to a part of said guiding groove to provide a pivot for rotation of said process cartridge in a direction of releasing engagement between said first projection and said positioning recess.

95. An image forming apparatus for forming an image on a recording material, to which apparatus a process cartridge is detachably mountable, said apparatus comprising:

a. a guiding groove extended in an inclined direction for guiding a process cartridge;

said process cartridge including:

an electrophotographic photosensitive drum;

process means actable on said electrophotographic photosensitive drum;

a cartridge frame;

a first projection for positioning said process cartridge at a predetermined position in said main assembly when said process cartridge is mounted to said main assembly, said first projection being projected outwardly from a longitudinal end of said cartridge frame in a direction of an axis of said electrophotographic photosensitive drum;

a second projection functioning as a pivot for rotation of said process cartridge in a direction of releasing positioning of said first projection to demount said process cartridge from the main assembly, said second projection being projected outwardly from a longitudinal end of said cartridge frame at a position above said first projection and downstream of said first projection in a direction of demounting said process cartridge from the main assembly when said process cartridge is mounted in the main assembly;

a grip provided above a line connecting a center of said first projection and a center of said second projection as seen from an extension of the axis of said photosensitive drum, wherein the positioning of said first projection is released by gripping said grip to apply force in the demounting direction and rotating said process cartridge about said second projection;

wherein said first and second projections are guided along said guiding groove of the main assembly;

b. a positioning recess continuing to said guiding groove, wherein when said process cartridge is mounted to the main assembly, said positioning recess is engaged with said first projection to position said process cartridge at the predetermined position.

* * * * *

UNITED STATES PATENT AND TRADEMARK OFFICE

CERTIFICATE OF CORRECTION

PATENT NO. : 5,937,240

DATED : August 10, 1999

INVENTOR(S) : KAZUHIKO KANNO, ET AL.

It is certified that error appears in the above-identified patent and that said Letters Patent is hereby corrected as shown below:

COLUMN 1

Line 45, "In" should be deleted.

COLUMN 2

Line 4, "is" should read --are--.

COLUMN 10

Line 48, "an" should read --and--.

COLUMN 12

Line 14, "lenght" should read --length--.

COLUMN 16

Line 52, "FIG." should read --to FIG.--.

UNITED STATES PATENT AND TRADEMARK OFFICE

CERTIFICATE OF CORRECTION

PATENT NO. : 5,937,240

DATED : August 10, 1999

INVENTOR(S) : KAZUHIKO KANNO, ET AL.

It is certified that error appears in the above-identified patent and that said Letters Patent is hereby corrected as shown below:

COLUMN 18

Line 41, "is" should be deleted.

COLUMN 23

Line 22, "an" should be deleted.

COLUMN 25

Line 19, "said," should read --said--.

COLUMN 33

Line 48, "claim 63," should read --claim 64,--.

COLUMN 39

Line 30, "including" should read --includes--.

Signed and Sealed this

Fifteenth Day of August, 2000

*Attest:*

*Attesting Officer*

Q. TODD DICKINSON

*Director of Patents and Trademarks*